US005166698A

United States Patent [19]

Ashbaugh et al.

[11] Patent Number: 5,166,698

[45] Date of Patent: Nov. 24, 1992

[54] ELECTROMAGNETIC ANTENNA COLLIMATOR

[75] Inventors: Fred E. Ashbaugh, Seattle, Wash.; Ordean S. Anderson, New Prague, Minn.; Donald E. Anderson, Northfield, Minn.; Ramakrishna A. Nair, Mankato, Minn.; Michael J. Riebel, New Ulm, Minn.

[73] Assignee: Innova, Inc., Kent, Wash.

[21] Appl. No.: 506,682

[22] Filed: Apr. 6, 1990

Related U.S. Application Data

[63] Continuation-in-part of Ser. No. 295,805, Jan. 11, 1989, Pat. No. 5,117,240, which is a continuation-in-part of Ser. No. 142,230, Jan. 11, 1988, abandoned.

[51] Int. Cl.[5] ..... H01Q 13/020; H01Q 19/080

[52] U.S. Cl. ..... 343/783; 343/786

[58] Field of Search ..... 343/753, 783, 786, 784, 343/785, 910, 911 R, 909, 911 L

[56] References Cited

U.S. PATENT DOCUMENTS

| | | | |
|---|---|---|---|
| 2,273,447 | 2/1942 | Ohl | 343/783 |
| 3,389,394 | 6/1968 | Lewis | 343/753 |
| 3,521,288 | 7/1970 | Schell | 343/783 |
| 3,886,561 | 5/1975 | Beyer | 343/911 R |
| 4,288,337 | 9/1981 | Ota et al. | 343/911 R |
| 4,447,811 | 5/1984 | Hamid | 343/783 |
| 4,510,469 | 4/1985 | Bowman | 343/783 |

FOREIGN PATENT DOCUMENTS

| | | | |
|---|---|---|---|
| 0130548 | 12/1948 | Australia | 343/783 |
| 0903474 | 8/1949 | Fed. Rep. of Germany | 343/783 |
| 1904130 | 7/1970 | Fed. Rep. of Germany | 343/783 |
| 0068542 | 6/1978 | Japan | 343/783 |
| 0219802 | 12/1983 | Japan | 343/786 |

OTHER PUBLICATIONS

Berberich et al. The Dielectric Properties of Rutile Form of $TiO_2$ Journal of Applied Physics, vol. 11, Oct. 1940, pp. 681-692.

Radiation Behaviour of a Dielectric Loaded Double--Flare Multimode Conical Horn with a Homogeneous Dielectric Sphere in Front of its Aperture. Montech, 86, IEEE Conferences, 4 pages, 1986.

*Primary Examiner*—Rolf Hille
*Assistant Examiner*—Peter Toby Brown
*Attorney, Agent, or Firm*—Douglas L. Tschida

[57] ABSTRACT

A dielectric inset mountable within a conical horn antenna for focusing an impinging electromagnetic wave front as a planar wave front at an attached wave guide. In one construction a homogeneous inset having an ellipsoidal forward surface and conical aft surface is fitted into a double flared conical antenna including a cylindrical, hybrid mode matching section. In various alternative compound constructions, materials of differing dielectric constants and geometrical shapes are arranged to facilitate a size and weight reduction of the inset and focus the incident wave front relative to the wave guide. In other embodiments, still lower density materials, including suspended metallic particulates are used.

22 Claims, 14 Drawing Sheets

ELECTROMAGNETIC ANTENNA COLLIMATOR

CROSS REFERENCE TO RELATED U.S. APPLICATION DATA

This is a continuation-in-part of application Ser. No. 295,805, filed Jan. 11, 1989, U.S. Pat. No. 5,117240 which is a continuation-in-part of application Ser. No. 142,230, filed Jan. 11, 1988, abandoned.

BACKGROUND OF THE INVENTION

The present invention relates to communication antennas and, in particular, to a bi-directional, dielectric loaded, conical horn antenna, for point-to point communications, particularly home and commercial satellite. Interiorly, the antenna body includes a plurality of conical stages of successively increasing flare angles, hybrid mode producing discontinuities and electromagnetic collimating apparatus.

Critical to the performance of any electromagnetic communication system are its transmitting and receiving antennas. The transmitting antenna is used to direct or focus radiated power in a desired direction toward a receiving antenna which is mounted to detect the transmitted radiation, while receiving a minimum amount of noise from sources radiating along adjacent axes. The use of directional antennas exhibiting relatively high on-axis gain and minimal off-axis side lobes or other undesired signal characteristics enhance the ability to communicate point-to-point. A further desired attribute of such antennas is an ability to focus or amplify the free-field radiation without cross-polarization, since most communication channels use two linearly polarized signals whose electric fields are oriented at right angles to one another.

With the above in mind and appreciating the high cost per unit area of paraboloidal reflector antennas and avowed interest in developing television broadcast and/or data communication systems using satellites in geostationary orbit—not to mention systems for satellite communications, radar and radio astronomy and terrestrial communications— considerable interest exists to develop improved antenna systems of high directivity. Appreciating also that there is only one geostationary orbit, the Clarke orbit, only a finite number of satellites can be positioned in this orbit. It will therefore be necessary to space the satellites as closely as possible.

Improved ground station antennas will consequently be required. These antennas should radiate or receive circularly polarized planar wave fronts with high gain and directivity relative to the longitudinal axis of the antenna. Losses at the receiving aperture and over the length of the antenna should be minimal. Transmissions should further exhibit low side lobe levels to desirably avoid interference with transmissions between adjacent satellites and the earth.

The cross-polarization radiation level of transmissions should also be kept low. That is, antenna transmissions should have equal "E" and "H" plane radiation patterns. This will allow signals to be transmitted/received on opposite polarizations, which will enable diverse applications wherein communication standards require sending signals of different polarizations.

For satellite communications and other special applications, the transmitted/received energy beam should also be steerable. An antenna configuration with a variable beamwidth facility is preferred. The antenna configuration should accommodate a relatively wide band of frequencies, specific frequency ranges being accommodated with scaling or sizing adjustments to the antenna. Antennas for radio astronomy applications should exhibit the combined features of low cross polarization, suppressed side lobes, beamshaping and wide bandwidth, in addition to relatively high on-axis gain and improved directivity.

Reflector antennas, which are commonly used to receive microwave and shorter wavelengths, provide a relatively large reflective parabolic collector and exhibit broad-band gain characteristics. They also include a rear facing feedhorn capable of receiving broad beamwidths. The feedhorn is typically aligned with the signal axis and focal point of the collector to receive the focused signal and direct it to associated receiver electronics which appropriately convert and amplify the signal for its intended application.

Although the collector of these antennas is constructed to receive and focus the primary signal, undesired side lobe signals are commonly received due to necessarily broad collector and feedhorn acceptance angles. These side lobes are more prevalent as the receiving antenna is positioned further and further from the equatorial orbit, which correspondingly reduces the reception angle, causing greater amounts of ground noise to be collected with the focusing of the antenna.

Applicants have found however that over a number of bandwidths, centered on frequencies corresponding, for example to "C" and "KU" microwave bands, a forward-facing, multiple section conical antenna having a relatively narrow acceptance aperture, high gain and low side lobe characteristics can be used by itself, independent of a large surrounding collector. This entire antenna is of a physical size comparable to the feedhorn only of many current reflector antennas. The housing construction of this antenna is particularly described in Applicant's U.S. application Ser. No. 295,805 entitled Multimode Dielectric-Loaded Double Flare Antenna, filed Jan. 11, 1988. For the interested reader and as regards the geometries of the antenna, Applicants direct attention thereto.

To the extent Applicants are aware of antenna designs including features bearing some similarities of appearance to those of the subject invention, Applicants are aware of U.S. Pat. Nos. 2,761,141; 3,518,686; 3,917,773; and 3,866,234. These references generally disclose externally mounted dielectric antenna lenses of various shapes.

Applicants are also aware of U.S. Pat. Nos. 2,801,413; 3,055,004; 4,246,584; and 4,460,901 wherein the use of dielectric structures in association with horn antennas are shown.

Relative to multi-flared feedhorn antenna designs, Applicants are also aware of U.S. Pat. Nos. 2,591,486; 3,898,669; 4,141,015; and 4,442,437 which disclose various rear facing reflector antenna feedhorn designs. Also disclosed are stepped discontinuities within the antenna horn. The 3,898,669 patent additionally discloses a multiflare rectangular horn antenna. None of the noted references however are believed to disclose the presently claimed combination of features for producing an antenna adaptable to a variety of frequencies, most particularly KU and C microwave bands, and/or antennas utilizing dielectric insets or electromagnetic collimators of the configurations and compositions of the present invention.

Applicants are also aware of two papers authored by one of Applicants which are descriptive of reflector antenna feedhorn constructions. These are Nair, R. A., et.al; "A High Gain Multimode Dielectric Coated Rectangular Horn Antenna", *The Radio and Electronic Engineer* (IERE), London, September 1978, pp. 439–443 and Nair, R. A., "Radiation Behavior Of A Dielectric Loaded Double-Flare Multimode Conical Horn With A Homogeneous Dielectric Sphere In Front Of Its Aperture", *Proceedings of the 1986 Montech Conference* (IEEE), Quebec, Sep.29–Oct. 3, 1986. Neither paper however discloses the following described combinations or singular features of homogeneous or heterogeneous dielectric collimators—conical or otherwise—that mount interiorly of the antenna horn body. The present insets also exhibit minimal contact with the electrically conductive horn interior.

SUMMARY OF THE INVENTION

It is accordingly a primary object of the invention to provide an antenna construction useful for receiving and transmitting a variety of frequencies in point-to-point communications.

It is another object of the invention to provide an antenna capable of receiving far-field, C-band and KU-band microwave frequencies, among other frequencies, at signal levels permitting usage in satellite down-link and up-link systems or for terrestrial communications.

It is a further object of the invention to provide an antenna exhibiting relatively high on-axis gain, low side lobe levels and low signal cross-polarization to improve the directivity of the antenna relative to geostationary satellites and to permit advantageous array configurations.

It is a further object of the invention to provide an antenna of minimal physical dimensions and weight whereby the antenna may be inconspicuously mounted about a home or business premises, such as to the roof or to a sidewall and/or which may even be personally carried in certain constructions.

It is a further object of the invention to provide a conical antenna of a multi-flared construction wherein interior sections of successively increasing flare angle and hybrid mode producing discontinuities are formed to optimize received radiation relative to the antenna axis by mixing and phasing self-generated higher order hybrid modes therewith.

It is a further object of the invention to provide an antenna including an electromagnetic dielectric collimator which mounts interiorly of the antenna horn to focus incident planar wave fronts received at a forward acceptance aperture relative to aft mounted electronics.

It is a further object of the invention to provide a collimator which produces a spherically convergent, in-phase wave front, focused at the input to a hybrid mode producing discontinuity or antenna matching stage and re-constitutes the wave front to a planar wave front at an aft waveguide.

It is a further object of the invention to provide a collimator formed of various densities of homogeneous and heterogeneous dielectric materials and varieties of interface geometries.

It is a yet further object of the invention to provide a collimator of minimum weight and physical size which in combination with the horn body enables an environmentally inert antenna interior.

Various of the foregoing objects and advantages of the present invention are particularly achieved in one presently preferred construction which comprises a rigid conical horn antenna. The antenna interior includes first and second conical stages of increasing flare angle, which differ from one another by two to ten degrees. The conical stages are coupled to one another via an intermediate cylindrical hybrid mode producing and phasing or matching stage. A uniform, electrically conductive thin film conductor covers the antenna interior.

Positioned substantially within the interior of the antenna is a dielectric collimator. The collimator is mounted to contact the conductor at a minimal number of points and serves in a receiving mode to convert incident planar, electromagnetic wave fronts to a planar wave front focused at an attached waveguide section. The flare angles of the antenna and the cylindrical matching section are otherwise formed to optimize the on-axis signal properties of the antenna.

Various alternative embodiments of conical collimators provide for homogeneous and sectional, heterogeneous constructions of differing densities and interface geometries from section to section. One disclosed geometry provides a homogeneous, conically shaped collimator having an ellipsoidal forward surface. Another provides a relatively short conical section which mounts at the matching stage and which exhibits a planar or phase corrected forward surface.

A variety of other sectional, heterogeneous collimators —the sections of which may or may not be independently supported within the horn body—provide a forward section constructed from a material exhibiting a relatively larger dielectric constant than following sections. The forward section converts incident planar radiation to a spherical phase front. Desirably, the section also minimizes signal degradation at the edges of the outer acceptance aperture. A variety of considered forward surface configurations range from non-elliptical to flat to Fresnel shapes, which may include metalized sidewalls at provided recesses or shapes formed to correct for off-axis phase aberrations in the incident wave-front.

The following collimator sections correctionally focus the radiation to the horn matching stage and aft waveguide and reconvert the radiation to a planar wave front at the aft waveguide. Interface surfaces between the various following sections otherwise alternatively exhibit planar or rotationally spherical, hyperbolic, or Fresnel shapes. Anti-reflective, tapered, rotationally spherical, elliptic or hyperbolic layers may also be provided at the interfaces.

In still other alternative multi-sectional constructions, the forward, planar-to-spherical phase front converting section is displaced from an interiorly positioned spherical to planar wave front converting section via an intermediate low-density filler or spacer section. The spacer section may intimately contact the walls of the horn body or an air gap can be provided.

In still another sectional collimator construction, an annular dielectric ring is mounted adjacent the matching stage and the forward surface of an aft section includes a coaxial, dielectric cylinder.

Depending upon the collimator configuration a gas tight, microwave transparent cover is mounted over the outer acceptance aperture and/or the collimator is bonded to the outer aperture at an annular ring of intersection to form an environmentally inert antenna interior.

Dielectric materials including randomly dispersed metallic particulates are also disclosed for reducing the density of the collimator sections.

The foregoing objects, advantages and distinctions of the invention, among others, as well as various detailed constructions will become more apparent hereinafter upon reference to the following description with respect to the appended drawings. Before referring thereto, it is to be appreciated the following description is made by way only of various presently considered alternative constructions. Where appropriate, variously considered modifications and improvements are mentioned. The invention however should not be interpreted in strict limitation to the disclosure but rather to the spirit and scope of the invention as claimed hereinafter.

DESCRIPTION OF THE PREFERRED EMBODIMENTS

Figure 1:
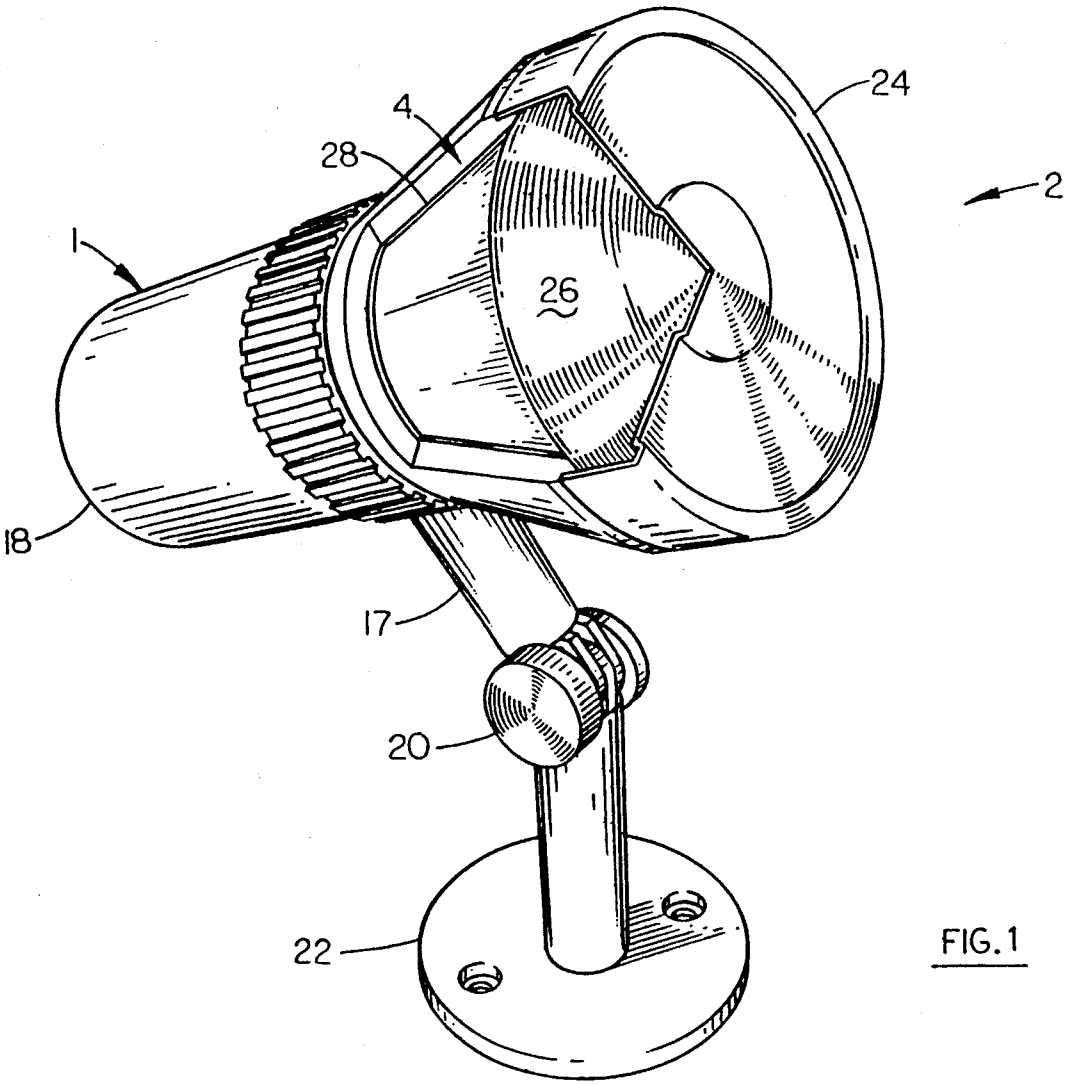
FIG. 1 taken along the longitudinal center axis is an isometric drawing in partial cutaway of the present antenna.
Figure 1A:
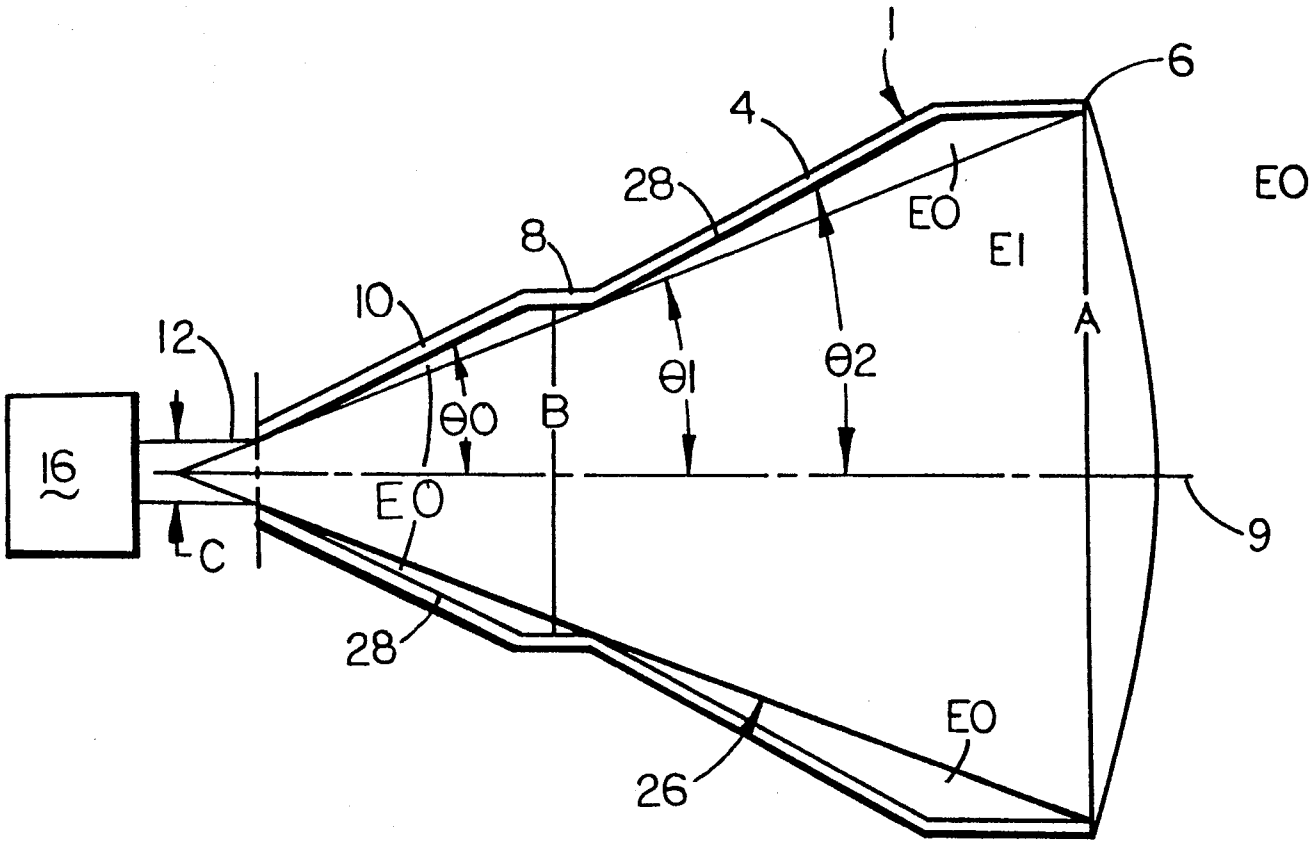
FIG. 1*a* shows a cross section view through the electrically active interior of the antenna of FIG. 1.
Figure 1B:
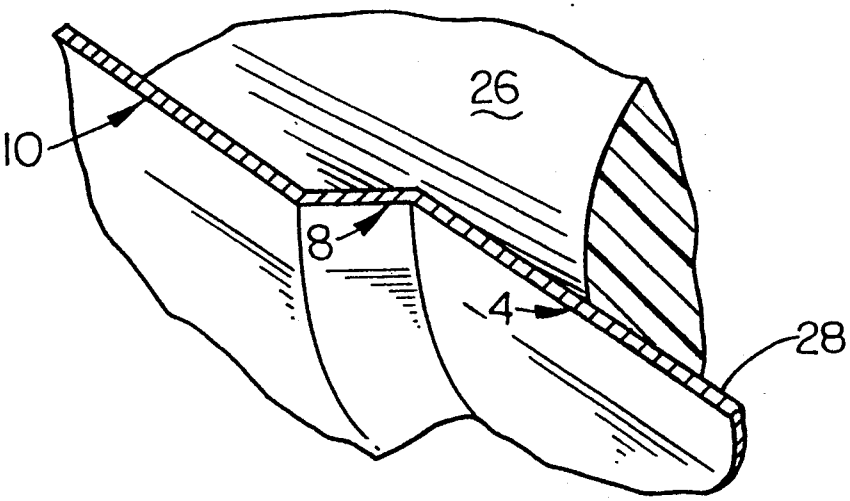
FIG. 1*b* is an isometric drawing of a partial section of the present antenna showing the air gap and cross hatching of the antenna body, conductive layer and collimator which cross hatching is otherwise deleted in other drawings for the sake of clarity.

Referring to FIGS. 1 and 1*a*, an isometric drawing and a cross-section view through the active portion of the antenna are respectively shown for a double-flare horn antenna assembly 2 of the subject invention. Such an assembly 2 is usable in any line of-sight communication system, for example, a satellite communication system. FIG. 1*b* shows an isometric drawing of the conductor 28 removed from the horn and the detail of the materials comprising the metalized conductor 28 and collimator 26, which detail is otherwise deleted from subsequent drawings in the interests of drawing clarity.

The antenna otherwise 2 generally comprises a horn body 1 having an outer conical stage 4 which tapers from an outer signal receiving aperture 6 of a diameter A inwardly at a half angular displacement of $\theta 2$ to an intermediate cylindrical coupler or matching stage 8 of a diameter B. Extending rearwardly from the coupler stage 8 is an inner conical stage 10 which is coaxially positioned with respect to the first stage 4 and a center longitudinal axis 9. The stage 10 tapers inward at a half angular displacement of $\theta 0$, which is typically one to five degrees less than $\theta 2$, and terminates in coaxial alignment with the input port to a waveguide transition region 12 of a diameter C. The waveguide 12 is selected to be compatible with a conventional low noise preamplifier, also known as a down-link or block converter (LNB) 16 which couples the received signals at frequencies compatible with a receiver tuner (not shown).

The block converter 16 mounts either within an aft portion 18 of the antenna housing 1 or to a support arm 17 coupled to or forming a part of the housing 18 which, in turn, pivotally mounts at a joint 20 to a support base 22. The support base 22 is attachable to a rigid structure, such as a rooftop or wall, and the joint 20 permits aiming the housing 1. Alternatively, the assembly 2 can be mounted on a remote controlled, steerable platform to permit selective re alignment with different polar coordinates for different satellites.

Secured substantially interiorly of the horn body 1, beneath an RF transparent, weatherproof cover 24, is a substantially solid bodied dielectric inset or electromagnetic collimator 26. For a conical horn body 1, the outer surface of the collimator 26 typically exhibits a unitary or multi-section conical frustrum shape and includes an appropriately shaped forward end.

The collimator 26 provides a necessary internal electrical environment to focus and appropriately delay and reconstitute portion of the received signal. That is during a reception mode, the collimator 26 functions over the length of the stage 4 to convert and focus a circular section of an incident planar, electromagnetic wavefront from a desired satellite to a spherical wavefront at the aperture to the coupler stage 8. There the signal energy received by a conductive or metalized interior surface 28 is focused relative to the aft waveguide 12 and via a mode transducer portion of the collimator, and optimized relative to the longitudinal axis 9 via the remaining cylindrical and conical stages 8 and 10.

The conceptual principles of the collimator 26 may be implemented in several forms as illustrated by the following FIGS. 1 through 12. All embody the same fundamental principle of operation but differ with respect to various physical characteristics that may be desired for specific applications. An important consideration of any overall design, however, is that the mode transducer portion within the stages 8, 10 of the collimator must be matched to the characteristics of the focusing portion within the stage 4 to achieve maximum efficiency.

Although the principles of operation of the collimator will be explained in detail by reference to FIGS. 1 to 12, those skilled in the art will be able to extend these principles to still other collimators. Although, too, the discussion that follows will consider the antenna 2 to be receiving an incoming signal, it is to be understood that the antenna 2 performs equally well as a transmitter, due to antenna reciprocity.

The forward surface of the collimator 26 otherwise serves to intercept a plane wave of electromagnetic radiation which is radiated from a distant transmitter such as may be located on a satellite or terrestrial relay station. At the aperture 6, the portion of the incident wave available to the antenna 2 consists of a cylindrical sample of the incident plane wave and within which sample, the wave is of uniform amplitude, distribution, and phase.

It is convenient to discuss this wave sample in terms of its Fourier components. For the cylindrical sample geometry, the Fourier expansion consists of an infinite set of hybrid waveguide (HE) modes where the electric field within the sample is given by:

$$E_t = \sum_{n=1}^{\infty} An\, HE_{1n}$$

Since approximately 92 percent of the energy within the sample is contained within the five lowest order modes and considering that some tapering of the plane wave sample at the outside edge is desirable to reduce close inside lobe levels, only the first few modes need be considered. It is to be understood, however, that the higher the order of mode accounted for, the higher the aperture efficiency that can be obtained.

As the wave passes through a focusing portion of the collimator 26 within the stage 4, it is focused at a point near the entrance to the mode transducer portion which is positioned substantially within the stage 10. In this region the higher order HE modes are converted to the lowest order $HE_{11}$ mode.

This transformation is accomplished by the mode transducer portion of the collimator 26. The dimensions and compositional shape of the mode transducer portion, as well as the dielectric constants of its components, are selected for optimum match to the mode content of the wave as it emerges from the forward collimator focusing section.

The wave sample is simultaneously refocused at the entrance to the mode transducer section to match a $TE_{11}$ wave mode at the exit at the waveguide 12.

More of the details of the construction of the horn body 1 and the operation of the stages 8 and 10 to optimize the received signal by creating and mixing higher order hybrid modes of the received frequencies can be found in the following description. Attention is also directed to Applicant's earlier identified patent application and papers. Generally, however, the stages 8 and 10 in the presence of the collimator 26 reconstitute and mix, in-phase, a portion of the received signal to produce a resultant usable signal, which in the aggregate includes energy otherwise lost to accentuated side lobes and other undesired signal properties experienced by predecessor antennas.

In contrast to Applicant's earlier work, the collimator 26 of the present invention is supported in the horn body 1 in spaced apart relation to the conductor 28. That is, the collimator 26 exhibits a half flare angle $\theta 1$ where $\theta 1 < \theta 0 < \theta 2$. Contact between the collimator 26 and body 1 thereby primarily occurs only at the receiving aperture 6 and at the forward edge of the cylindrical matching stage. 8.

In Applicants' earlier work, a close contact was believed necessary over the entire horn body interior between the dielectric and conductive layer 28. It was also believed that a material of a relatively large dielectric constant and high density was required over the full length of the horn interior. This opinion and belief has been modified as will become more apparent hereinafter.

The collimator 26 is now designed to substantially fill the interior stages 4, 8 and 10 or, if not, to in combination with the cover 24 and a filler gas provide a weatherproof and environmentally inert horn interior. The geometry and materials of the collimator 26 are selected and varied for the various embodiments described hereinafter to enhance the effective size of the collection aperture 6; to minimize signal disruption at the aperture 6; to convert the received planar wavefront to a spherically convergent wave front focused on the longitudinal axis 9; to reconstitute the wavefront as a planar wave front focused at the input port to the waveguide 12; and to facilitate the creation and mixing of the desired higher order hybrid modes which optimize the characteristics of the received/transmitted signal over the stages 8 and 10.

Stated differently, the primary objective of the present antenna assembly 2 is to capture all of the energy within a planar wave-front impinging on a maximum effective area of antenna aperture and convert the maximum fraction of that energy to a planar wave which enters the aft mounted waveguide 12. This is accomplished via the conical stages 4 and 10 which in combination with the dielectric collimator 26 and cylindrical matching stage 8 are optimized to effect a planar to spherical wave front conversion of the received signal in the larger, outer stage 4, focused at the aperture to the matching stage 8. The converted wavefront is next provided with an appropriate fraction and phase orientation of higher order hybrid modes of the received energy in the matching stage 8. The hybrid modes are then combined with the advancing front over the interior stage 10 with the signal ultimately arriving at the waveguide 12 exhibiting a planar wavefront as it enters the waveguide 12. The E and H fields of the signal are particularly aligned with the longitudinal center antenna axis 9 and exhibit relatively low side lobes and cross polarization over the frequency band of interest (e.g. microwave frequencies of the KU band).

The present antennas have also been designed to provide an effective so called "noise temperature" on the order of 15 degrees Kelvin which includes a reasonable allowance for radiation from side lobes and back lobes from the warm earth, adjacent surfaces and from other electrical sources. Specifically, the antennas have been verified to exhibit an effective noise temperature of less than fifteen degrees Kelvin, when facing a satellite more than fifteen degrees above the earth.

With the above in mind, the dielectric collimator 26 of the present invention can, as a first order approximation, be analogized to an elliptical lens and be interpreted in relation to optical principles and related ray tracing theories. Optical principles do not however fully apply for a variety of reasons.

A first reason relates to the relative wavelength of light versus the wavelengths of the signals of present interest. That is, for a typical lens design at optical frequencies, the physical size of the lens is extremely large compared to the wavelength of the electromagnetic waves of light which are incident on the focusing surface. In fact, even though the surface may be curved at every point where a wave approaches the lens surface, the relative size difference of the approaching wave is always planar. Any wave exiting the lens is thereby always planar. As a consequence, Snell's Law, which describes the angle at which a plane wave approaches a planar interface and exits as a plane wave at some other angle, holds exactly.

For the present collimators, however, the entire diameter of the collimator is typically on the order of twelve wavelengths of the received radiation. Consequently, constructing the collimator from simple optical lens design principles alone would not produce an assembly capable of focusing incident electromagnetic waves at a perfect point.

Secondly, it should be recognized that the spherically convergent wave-front produced by the present collimators, as the wave approaches the matching stage 8, enters a region of extremely small dimension of diameter "B", for example, of the order of four of the radiation wavelengths. Necessarily, this constriction affects the received wave.

The electromagnetic radiation, moreover, is not moving through a simple medium having a constant velocity of propagation, nor is it a plane wave. Rather, the wave is moving essentially parallel to a metal boundary which appears to the wave as a region of infinite dielectric constant. The boundary conditions of Snell's Law, which the electromagnetic wave must satisfy if only optical principles are involved, and which influence the velocity of propagation of the wave within the entire cross section of the antenna aperture 6, are therefore not met. Thus, one cannot fully explain the present collimators by only using ray tracing arguments or simple optical focusing principles. These principles merely serve as guides.

Rather, the antenna body 1, the horn angles $\theta 1$, $\theta 2$ and $\theta 0$ and the collimator are determined on the basis of a complete solution to Maxwell's equations and its boundary conditions for waves close to metallic walls and in the presence of discontinuities and materials of finite dielectric constant. Accordingly, the overall electromagnetic effect of the dielectric collimator, in particular, its effective dielectric constant and geometry must be tailored across all the stages 4, 8 and 10. The effect must also be carefully adjusted to assure that Maxwell's equations continue to be satisfied at the metallic boundaries and within the active space of the entire antenna.

Figure 2:
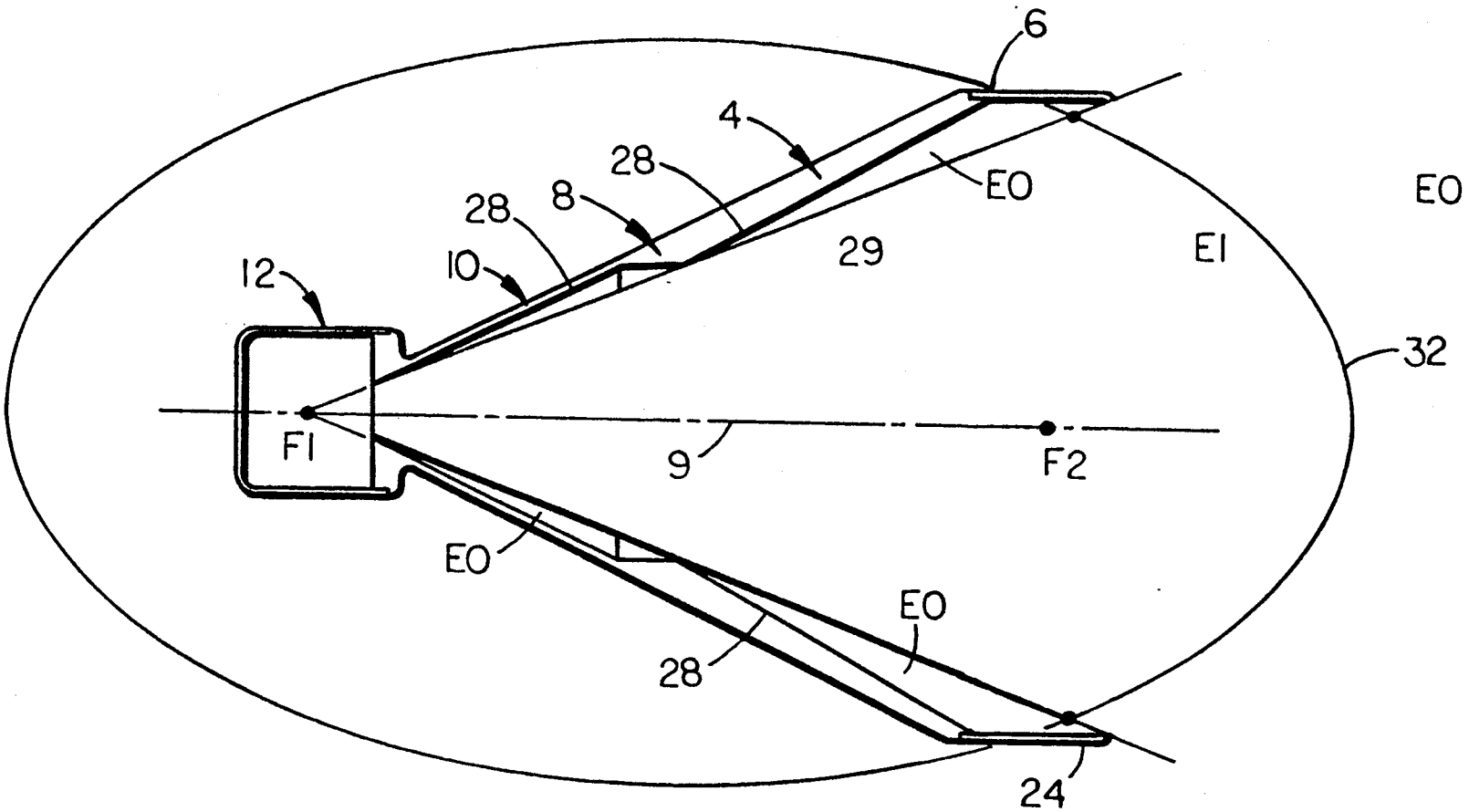
FIG. 2 shows a conceptual line diagram of a first order approximation and fitting of an imaginary, elliptical dielectric lens to the antenna.

As a first order approximation and with attention to FIG. 2, the focusing action of the present collimators can, again, be analogized to a simple solid bodied, homogeneous elliptical lens 32 of dielectric constant E1, where E1 is greater than the dielectric constant E0 of free space. FIG. 2 diagramatically shows such a lens 32 superimposed over an antenna housing 1 and aligned with the longitudinal axis 9. For such a lens, all of the radiation which impinges the depicted, right end surface is bent or focused as a spherically convergent radiation front to an imaginary first focal point F1, of two possible focal points F1 and situated along the common longitudinal center axis 9. A conical section 29 of the lens 32, matching the constraints of the proper horn body flare angles G0 and G2 can be extracted and used to focus incident radiation relative to the horn body axis 9. Preferably, the periphery of the lens should contact the aperture 6 to form a sealed horn body interior; otherwise the cover 24 or a support ring 25 (reference FIG. 3) seals the assembly 2.

Figure 3:
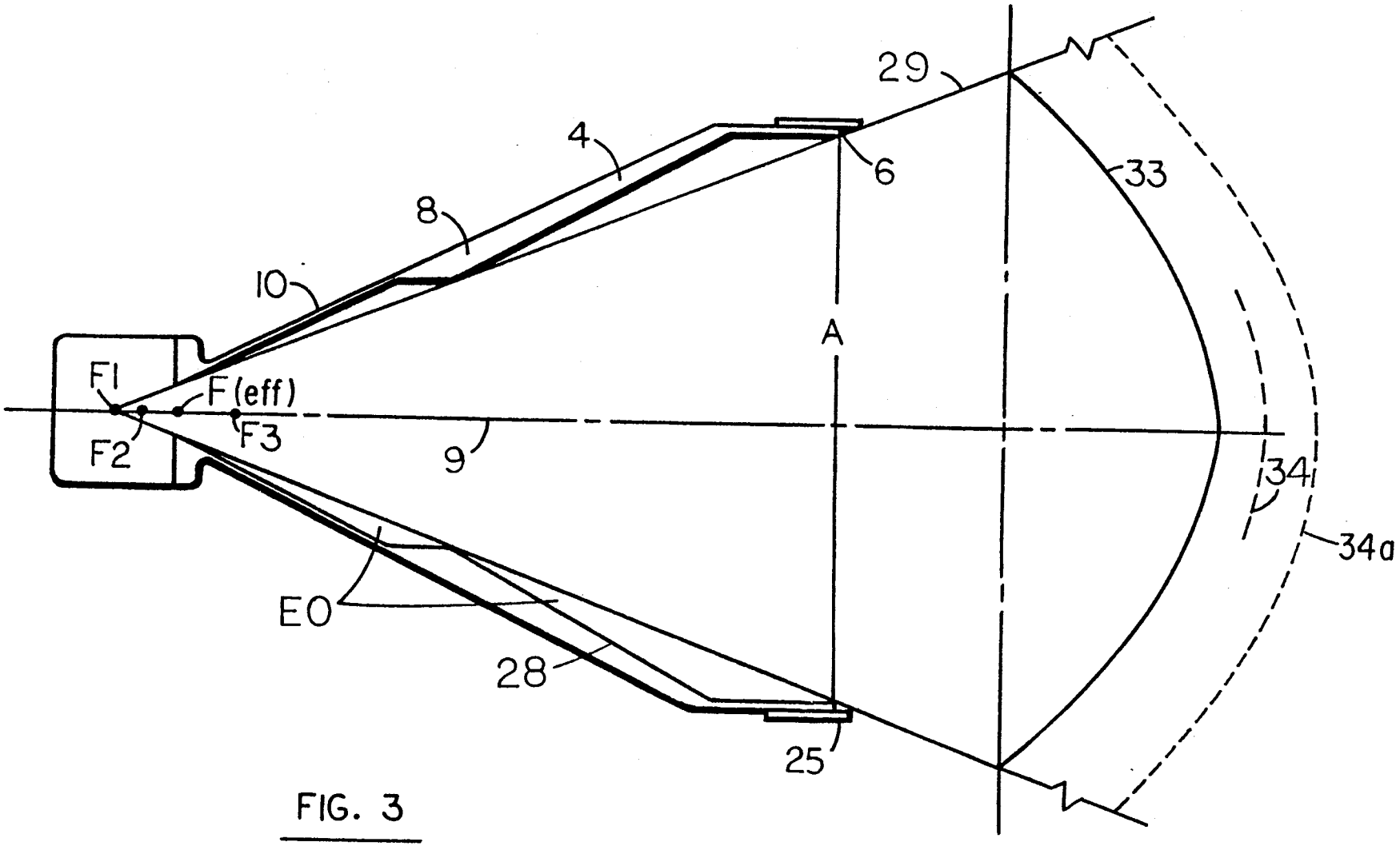
FIG. 3 shows a homogeneous collimator of extensible length which accommodates collimators to reduced density and provides a larger effective aperture.

Signal optimization requires that the focal point of the selected lens be displaced interiorly of the horn body and preferably aligned with the aperture to the waveguide 12. With reference to FIG. 3 the collimator 29 includes a lens surface 33, which is shown in relation to other possible lens surfaces 34, 34*a*. The collimator 29 contacts the receiving aperture 6 at a support ring 25 and operates to produce convergence at an effective focal point F(eff), not at the imaginary vertex or focal point F1 of the collimator 29 or of the vertex F2 of the stage 10 or even the vertex F3 of the stage 4, but rather somewhere in between and preferably at the aperture to the waveguide 12.

With this focusing action and conically shaped collimator in mind and a further desire to maximize the received energy, one could conceivably select the collimator section from a larger imaginary concentric, elliptical lens, such as either of the lenses 34 or 34*a*, until an effective aperture of any desired diameter is obtained, for example, 2A or larger.

Further purposes of the collimator are to capture and align incident radiation relative to the horn body 1, prior to entry of the horn body 1, and prevent aberrations at the edge discontinuities of the horn aperture 6. However and in conjunction therewith, the size, weight and cost of the combined assembly must be considered. Such considerations are especially important when taken in relation to the design objectives of an antenna assembly of small size and light weight and which is readily producible in mass quantities.

In this regard, experimentation has shown that materials of relatively higher dielectric constants facilitate shorter collimators. In particular, Applicants have developed homogeneous collimators of differing lengths and materials with each having a rotationally elliptic forward surface similar to those of FIGS. 2 and 3. One of such collimators, which terminated at the horn aperture 6, was formed from polyethylene and exhibited a dielectric constant of 2.26. Other collimators of various longer lengths were formed from a lighter density (9 pcf vs. 57 pcf) and less costly ETHAFOAM exhibiting a dielectric constant of 1.18. Comparable on-axis gains and radiation patterns were demonstrated between such structures only when the length of the collimator of low dielectric constant foam material was extended beyond the horn body 1, approximately one and a half times the length of the horn body 1. Although functionally equivalent, lighter weight and less costly, the excessive size of such a collimator negated the weight advantages of the foam for the present applications.

Understanding also that the effective focal point F(eff) can be shifted with the type of collimator material used and/or the shape of various boundary interfaces encountered by the incident radiation, either a higher dielectric homogeneous collimator or a composite assembly is suggested. From the foregoing experimentation, a composite construction is particularly suggested as preferable in that the higher density materials by themselves are relatively costly and also increase the weight and difficulty of manufacture of the collimator.

Various collimator geometries, which will be discussed below with respect to FIGS. 4 through 12, have therefore been developed to create an electromagnetic collimator of a relatively short length; which mounts within the angular constraints of a horn body 1 that has been optimally configured to particular frequency bands of interest; which exhibits a relatively light weight; which converts the incident energy to a spherical wavefront at the outer aperture of the cylindrical matching stage 8 and focused relative to the aperture of the waveguide 12 (i.e. a point displaced forward of the focal point F1 of the imaginary first order homogeneous lens 32); and which reconstitutes the wavefront over the stages 8 and 10 to a planar wave at the aperture to the waveguide 12.

Applicants have attained these objects through the construction of heterogeneous collimators, wherein materials of differing dielectric constants and geometries are mated with one another within conical constructions that fit the optimized angular constraints of G0 and G2 and drift space constraints of the matching stage 8. Accordingly, all of the following collimator constructions presume a horn body 1 of identical configuration and to which the materials and shapes of the collimators are fitted.

Figure 4:
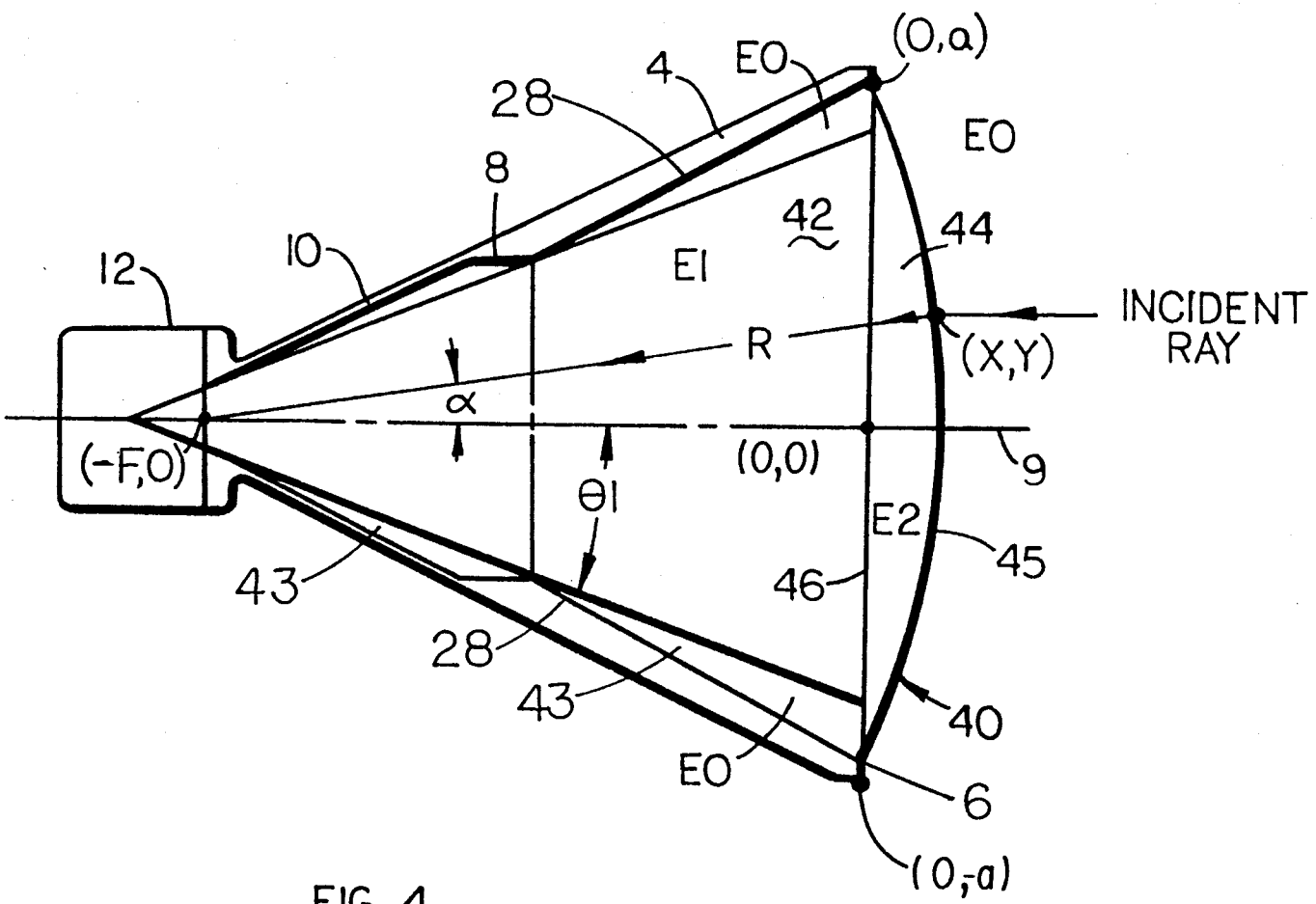
FIG. 4 shows a cross-section drawing through an antenna including a heterogeneous collimator having a rotationally spherical forward surface and a flat planar rear surface.

Referring to FIG. 4, a two-section heterogeneous collimator 40 is shown. A section 42 of the collimator 40 is sized to substantially fill the entire aperture 6 and interior of the horn body 1 and is formed of a comparatively low dielectric constant material having a dielectric constant E1, such as foam. An outer, larger diameter section 44 is formed of a material having a higher dielectric constant material E2 and exhibits a rotationally spheroidal or non-elliptical forward surface 45. The larger diameter of the section 44 is intended to capture more of the incident radiation near the edges of the aperture 6 and re-direct the radiation to minimize disruptions as the wave enters the aperture 6.

The re-direction and focusing of the incident ray relative to the interfaces between the dielectric sections 44 and 42 with free space and each other is shown, for illustration only, by way of a conceptual ray. As previously discussed, simple ray tracing theories do not fully apply. The focus F(eff) of the re-directed radiation ideally occurs at the aperture (defined by the coordinates 0,A and 0,−A) to the waveguide 12 (defined by the coordinates −F,0). Otherwise, the specific material and shape of the forward surface 45 of the section 44 are determined to produce spherical convergence of the received radiation at the aperture to the matching stage 8 (depicted in dashed line). As will be discussed in greater detail below, the shape of the surface 45 can be derived using Snell's Law with selected values of E1 and E2 relative to the radius R of the outer surface 45 for all values of an angle Alpha (d) to a maximum value $\alpha$ m, which fills the aperture 6 or $A=2a$.

The half flare angle $\theta 1$ of the internal collimator section 42 is determined to provide an air gap 43 of dielectric constant $E0=1$, over the entire horn interior. Minimal contact occurs at the aperture to the matching stage 8 only to support the collimator 40 within the horn 1. The air gap is required due to the constraints of the derived relative shape and sizes of the horn stages 4, 8 and 10 and conformance to the determined Maxwell solutions. This, again, is in contrast to Applicants' earlier work, where essentially no air gap was provided and only conformal dielectric coatings or mating concentric conical insets were used.

The interface surface 46 between the collimator sections 42 and 44 is, in turn, matched to facilitate further focusing of the advancing, spherically convergent wave relative to the aperture to the waveguide 12. A planar surface 46 and a spherically convex interface surface 48 are respectively used to this end in the collimators 40 and 50 of FIGS. 4 and 5. Alternatively, the interface surface can be shaped to include off-axis aberrations for achieving phase correction, reference the surface 64 of FIG. 6. The specific shape and positioning of the aberrations will essentially depend upon an empirical cut-and-try final fitting or optimization of a collimator to the antenna assembly 1.

Design equations for the contours of the forward or outer surface 45 primarily depend on the desired focal point F for the received signal, the size of the horn body 1, the diameter of the aperture 6, and the three encountered values of dielectric constant E1, E2 and E0. It is to be noted that in some cases, E1 may be set equal to E0, as in the collimator of FIG. 8, but which will be discussed below.

In FIG. 4, the outer surface 45 is particularly shaped to provide essentially zero thickness adjacent the extremities of the horn aperture 6, where the cartesian coordinate y equals the aperture radius of "a" and x equals zero. For all other values of $y<a$, the surface 45 is designed so that the angle between the plane wave approaching the collimator 40 and the desired convergent wave satisfies Snell's Law and Fermat's Principle. These equations, in turn, specifically define the values of x and y for each value of R and an alpha value ranging from zero (i.e. the longitudinal axis 9) through $\alpha$ m where R must equal the square root of F2 plus a2 for the simple right triangle. It is to be appreciated the collimator section 42 may be cut short to better mount within the horn body 1. It is also to be appreciated that the focal point defined as (−F,O) doesn't necessarily occur at the physical vertex of the conical collimator.

The values of the coordinates (x,y) defining the front surface 45 of the collimator section 44, and having a planar interface surface 46 between the collimator sections 42 and 44, can otherwise be derived as:

$$x = \frac{\sqrt{E1}\ F\left[\sqrt{1 + a^2/F^2} - 1/\cos\alpha\right]}{\left[\dfrac{\sqrt{E2}}{\sqrt{1 - \left(\dfrac{E1}{E2}\right)\sin^2\alpha}} - 1\right]},$$

-continued $$y = F\tan\alpha + x\tan\cos^{-1}\left[1 - \left(\frac{E1}{E2}\right)\sin^2\alpha\right].$$

Figure 5:
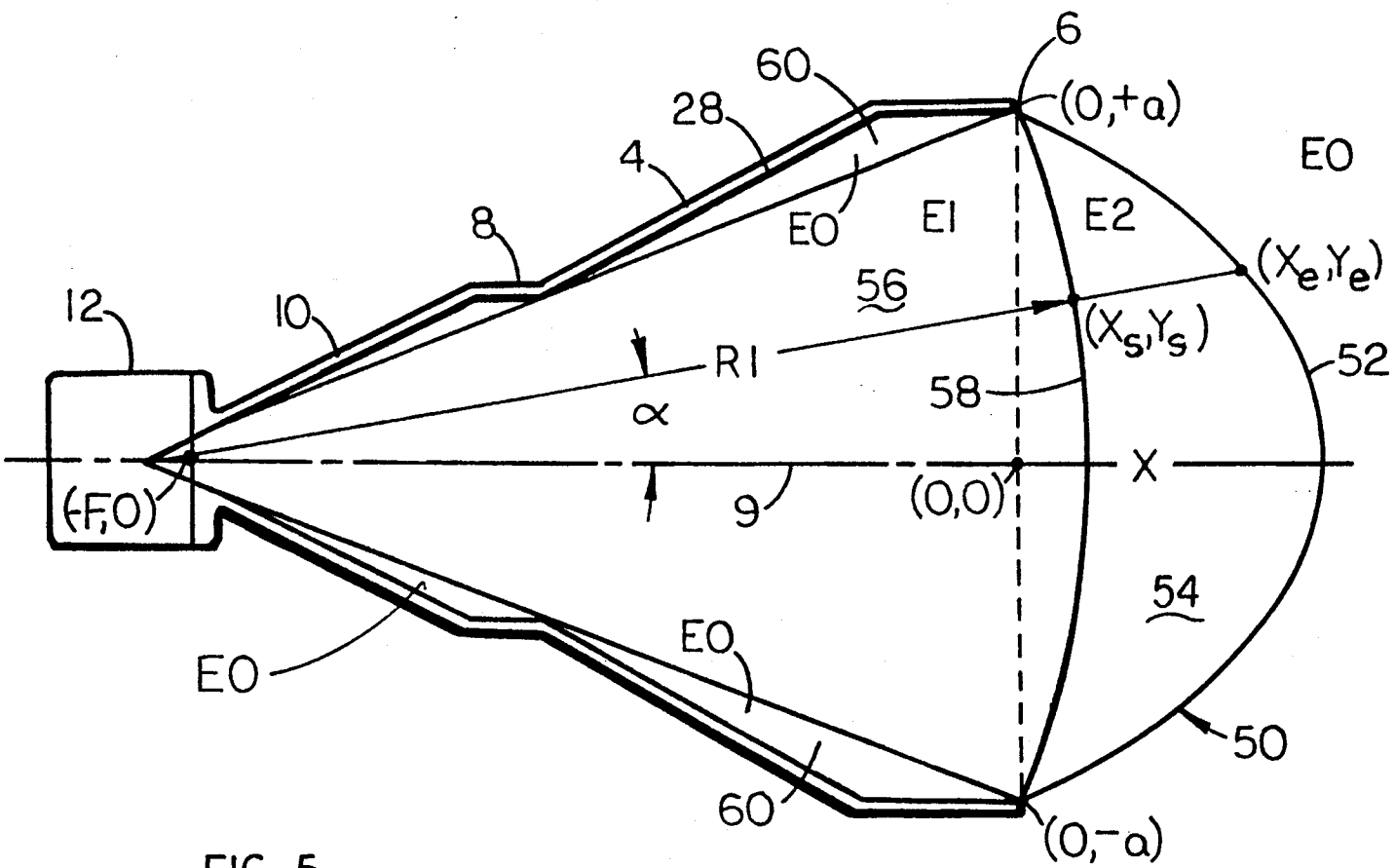
FIG. 5 shows a cross-section drawing through an antenna including a two-section heterogeneous collimator having a rotationally elliptical forward surface and a spheroidal interface surface.

FIG. 5 depicts an alternative collimator 50 which provides for refraction or bending of the incoming radiation front at only the outer surface 52 of the collimator section 54 and without refraction at the interface surface 58 between the collimator sections 54 and 56. That is, a compound dielectric interface is provided for focusing a received planar wave to a spherical wave completely within collimator section 54 and independent of the dielectric discontinuity at the interface surface 58 or the adjacent air gap 60 between the collimator 50 and the conductor 28.

In this regard, an interface surface 58 of spherical rotation between collimator sections 54 and 56 particularly replaces the planar interface surface 46 between collimator sections 42 and 44 of FIG. 4. The surface 58 is characterized by a line of constant radius R1 which equals the square root of F2 plus a2 and which extends from the point of focus at (x=−F, y=0) to the edge of the horn aperture 6 where (x=0, y=+a). The elliptical forward surface 52 otherwise initiates bending of the received planar wave and formation of a spherical wave which passes through the interface surface 58 at normal incidence at every point on the surface 58.

The shape of the interface surface 58 is also independent of the dielectric constant E1 of the collimator section 56. That is, one can replace a portion of the collimator section 56 with air and not change the shape or the position at which the collimator section 56 is placed. Preferably, however, the filling of the horn interior with a solid dielectric material is believed to reduce the likelihood of degradation of the metalized conductor surface 28.

Figure 6:
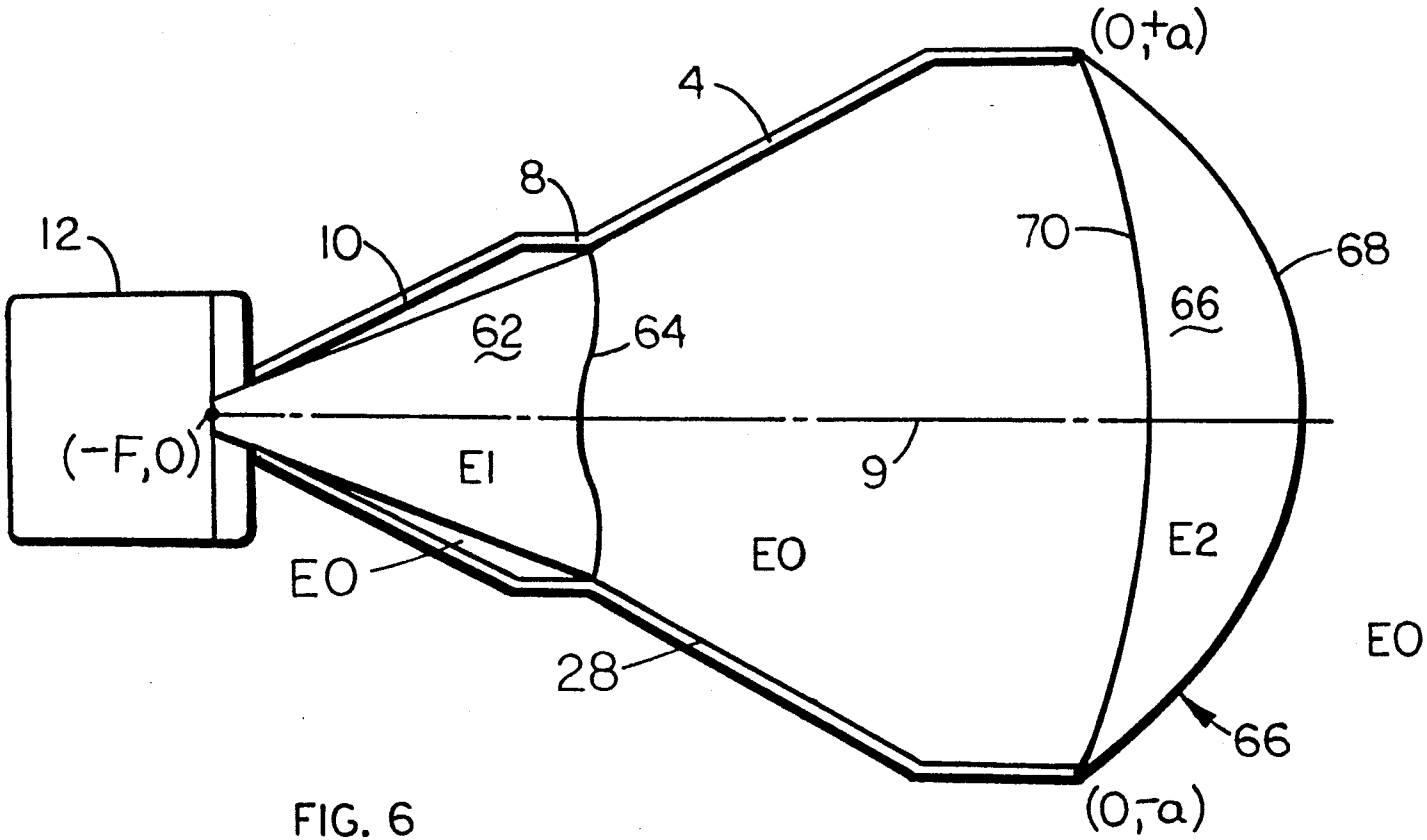
FIG. 6 shows a cross-section drawing through an antenna including a two-section heterogeneous collimator separated by an air gap, wherein the forward section is similar to that of FIG. 5 and the aft section exhibits a phase-correcting front surface.

If an air space were provided and with additional attention to FIG. 6, mode conversion a collimator section 62 must still be included within the stages 8 and 10 to assure satisfaction of the determined electromagnetic field boundary condition requirements. The leading surface 64 of the collimator section 62 is shaped to correct for off-axis signed aberrations. That is, zones of additional or less dielectric material provide phase adjustments to the spherical wave and assure receipt of a planar wave at the forward aperture to waveguide 12.

Otherwise, the shape of the outer surfaces 52 and 68 of the forward collimator sections 66 and 54 of FIG. 5 and 6 each satisfy Snell's Law and Fermat's Principle. Radiation incident on these surfaces passes through the aperture points where y=+a and x equals zero and the surfaces provide sufficient curvature to bend the incoming plane wave to finally pass through the desired focal point F. The surfaces 52 and 68 particularly comprise a simple ellipsoid of revolution and depend upon the dielectric constant E0 and E2, but not E1. The equation for derivation of the surfaces 52 and 68 is:

$$R(\alpha) = \frac{(X_M + F)(\sqrt{E2} - 1)}{\sqrt{E2} - \cos\alpha}, \text{ where}$$

$$X_M = \frac{1}{1 - 1/\sqrt{E2}} \times F \times [\sqrt{1 + a^2/F^2} - 1]$$

The coordinates (x,y) of the elliptical surfaces 52 and 68 are thereby determinable as:

$$x = R\cos\alpha - F$$
$$y = R\sin\alpha$$

The interface surface 70 of the collimator section 66 with the interior free space otherwise comprises a spherical surface centered at the focal point (−F,0).

A further variation of a forward collimator section which has been verified to be effective for the intended purpose is a so called Fresnel configuration. Such a configuration, however, tends to be slightly less efficient in terms of electrical performance than others of the collimators discussed herein. Its advantage primarily lies in the ability to reduce the weight of the dense forward collimator section.

Figure 7:
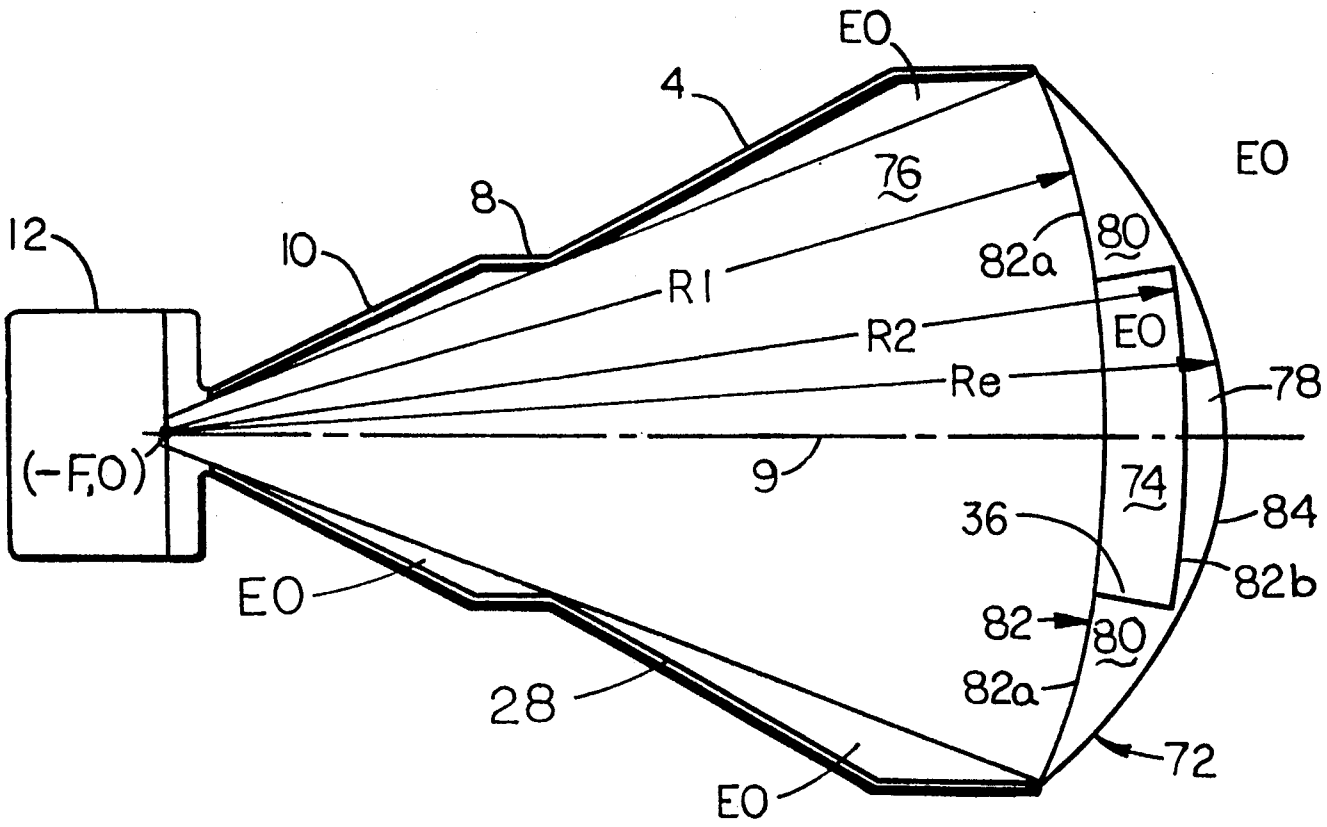
FIG. 7 shows a cross-section drawing through an antenna including a two-section heterogeneous collimator having an elliptical forward surface and Fresnel-shaped interface surface.

One such collimator construction 72 is shown in FIG. 7 and wherein an advantageous weight reduction is achieved. That is, the aggregate volume of the forward collimator section 72 is less than the previous collimator sections 44 and 54. Weight reduction is particularly achieved due to the hollowing of the higher density material at a cavity 74, which is symmetrical to the longitudinal axis 9.

For the dimensional constraints imposed by the signal frequencies of interest, the collimator 72 typically comprises a two-zone Fresnel construction composed of annularly concentric zones 78 and 80. The cavity 74 for such a construction can either be occupied by a portion of an aft collimator section 76, or not, as desired. So long as the delayed radiation at all points over the section 72 are in phase upon reaching the interface surface 82, comprised of portions **82*a* and 82*b*, the thickness of the zone 78 need not be as thick as the outer zone 80. As a consequence, the collimator section 72** can be hollowed (as depicted) and generally made in a fashion which facilitates fabrication, such as by injection molding.

Equally important to the concern to reduce the aggregate weight of the collimator is that the cost to mold the relatively massive collimator sections 40, 50, 54, 66 and 72 from polyethylene or polystyrene, depends largely on the thickness of the molded section. The thickness, in turn, controls the cure or cooling time that the injection molded part must remain in the mold before it can be removed and still remain dimensionally stable. Thus and for example by replacing a unitary outer section 44 with a composite relatively thin assembly 72 comprised of sections 78 and 80, fabrication is facilitated, while reducing cost and weight.

Whereas, too, the forward surface 84 is formed [as an] to exhibit a three dimensionally elliptic surface of rotation, symmetrical 6 the longitudinal axis 9 the interface surface portions **82*a* and 82*b*, defined by R1 and R2 relative to the focal point (−F,0) are formed as a spherical surfaces of rotation. The peripheral sidewall 86 of the cavity 74 is otherwise formed at a normal or 90 degree orientation to the interface surface 82*a* and 82*b*. The difference in path length for radiation incident on the surfaces 82*a* and 82*b*** is thus:

$$\Delta R = R_2 - R_1 = \lambda_o/(\sqrt{E2} - \sqrt{E3}),$$

where $\lambda_0$ is the free-space wavelength of the incident electromagnetic (EM) wave.

Figure 8:
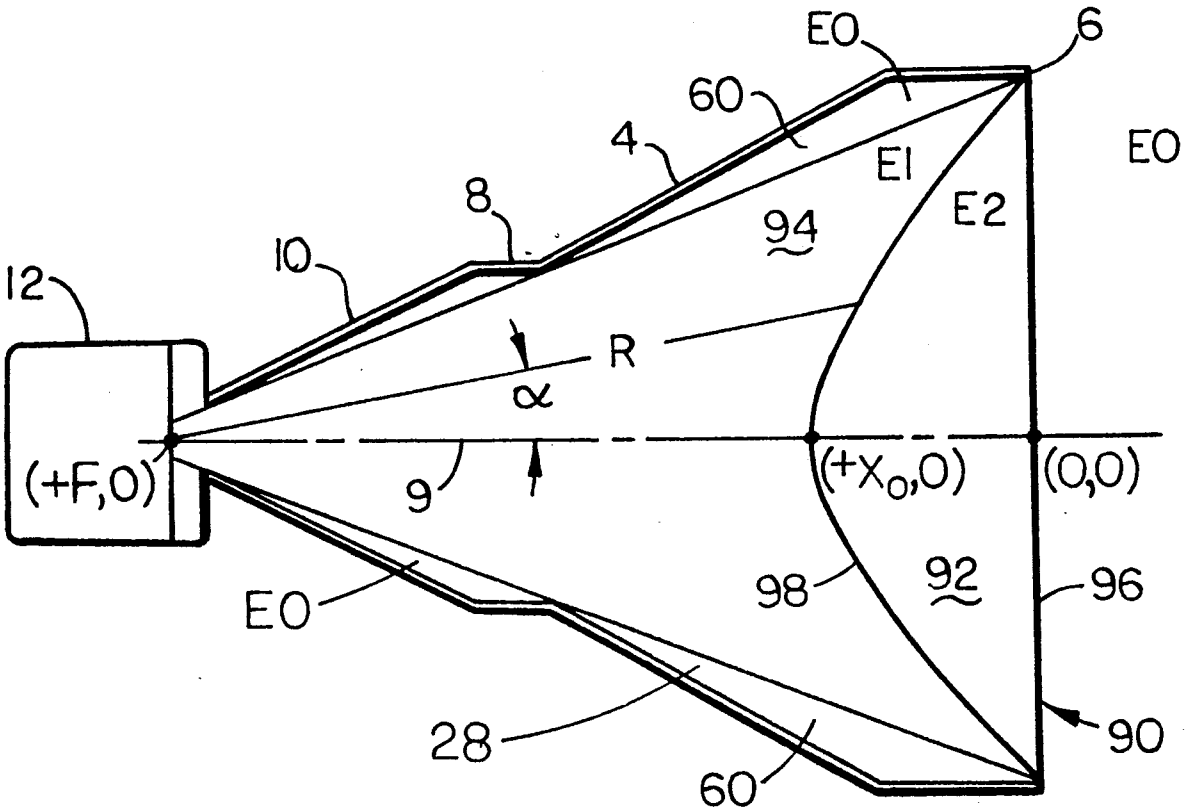
FIG. 8 shows a cross-section drawing through an antenna including a heterogeneous collimator having a flat forward surface and a hyperbolic interface surface.

FIG. 8 depicts yet another alternative two section collimator 90 which can be derived by applying Snell's Law and Fermat's Principle. For this construction, the overall length of the antenna assembly 2 is significantly decreased by allowing the higher dielectric constant, forward collimator section 92 to penetrate into an interior section 94. In particular, a planar forward surface 96 is exposed to free space. An internal interface surface 98, in turn, is shaped as a hyperbolic surface of rotation, symmetrical with respect to the longitudinal axis 9 per the following equation:

$$R(\alpha) = \frac{(F - X_o) \times [\sqrt{E2} - \sqrt{E1}]}{\sqrt{E2}\ \cos\alpha - \sqrt{E1}}$$

where, $$X_o = F - \sqrt{F^2 + a^2} \times \frac{[\sqrt{E2}\ \cos\alpha_m - \sqrt{E1}]}{\sqrt{E2} - \sqrt{E1}};$$

$$\alpha_m = \tan^{-1}(a/F)$$

and x is measured positively from the planar interface surface 96. Xo thus represents the thickness of the section 92 at the longitudinal axis 9, where y=0. The coordinates of all points on the interface surface 98 are therefore, $$x = F - R\cos\alpha$$

$$R\sin\alpha.$$

As before, the thickness of the collimator section 92 is dependent upon the dielectric constants E1 and E2, which again are selected to assure that a received wave front is proportionally delayed over all points of the collimator section 92 to assure a phased transition and receipt of a spherically convergent wave front at the aperture to matching stage 8.

Appreciating the electrical and constructional significance of the dielectric materials used to form the collimator sections 42, 44; 56, 54; 62, 66; 76, 72; and 94, 92, it is to be noted the inner collimator sections are selected to exhibit relatively low dielectric constants E1 of the order of 1.15 to 1.25. Exemplary materials are foamed, low loss (i.e. at frequencies in the range of 12 GHz) plastics, such as polystyrene or polyethylene. The outer collimator sections, in turn, are preferably constructed of materials exhibiting a dielectric constant on the order of 2.0 to 2.5. Such values can also be achieved with bulk polystyrene or polyethylene. These latter materials also exhibit low losses at the frequencies of interest and are capable of being injection molded.

The dielectric constant of these materials in blown or foamed form, as opposed to bulk form, and when, for example, being used to form the collimator sections 42, 56, 76 and 94 can be described directly as a function of the fraction of bulk density. This equation is:

$$E(D) = 1 + [E(D_M) - 1] \times \frac{D}{D_M}$$

where Dm is the maximum (bulk) density and D is the density of the foamed plastic. For example, for an E1 material such as nine pound per cubic foot expanded polyethylene, sold under the brandname of ETHAFOAM, a dielectric constant of the order of 1.18 is exhibited. Bulk polyethylene, in contrast and at a density of 57 pounds per cubic foot has a dielectric constant of 2.26 at 12 GHz. These values are generally in accord with the above equation, which predicts a value of 1.20 for the foam.

By way of an improvement, Applicants have also found that even lower density foams combined with metal or electrically conductive particulates can be used with significant reductions in the weight, cost and related cycle times to expand these foams in a mold. For example, the foam may contain particles of copper, aluminum or nickel or, alternatively metal coated foam particles. The particles are randomly entrained into the foam matrix to provide a polarizable medium.

The dimensions of the particles are formed to be relatively small compared to a wavelength of interest. The thickness of the particle must also be several times the penetration depth of the electromagnetic field at the frequency of interest. For example, particles on the order of one millimeter are preferred, where the wavelength is of the order of 25 millimeters. Light-weight foams having acceptable dielectric constants and very low losses are thereby producible.

Applicants have particularly determined that an electrically equivalent foam collimator section, comparable to expanded nine pound per cubic foot ETHAFOAM, can be obtained with a one pound per cubic foot polystyrene. For such a foam, small platelets of aluminum foil on the order of one millimeter by ten micrometers were randomly distributed at a density on the order of 200 particles per cubic centimeter of foam. The total mass of such a collimator section was approximately one to two ounces, in contrast to one pound for an equivalent foam assembly without particulates.

In practice, there may also be advantages to completely filling the conic stage 4 with a collimator section of foam so as to follow the horn wall with no air gap. The collimator section may also be extended beyond the state 4, as a simple cylinder, until an apparent aperture is obtained wherein all the convergent rays are contained in the dielectric material.

Figure 9:
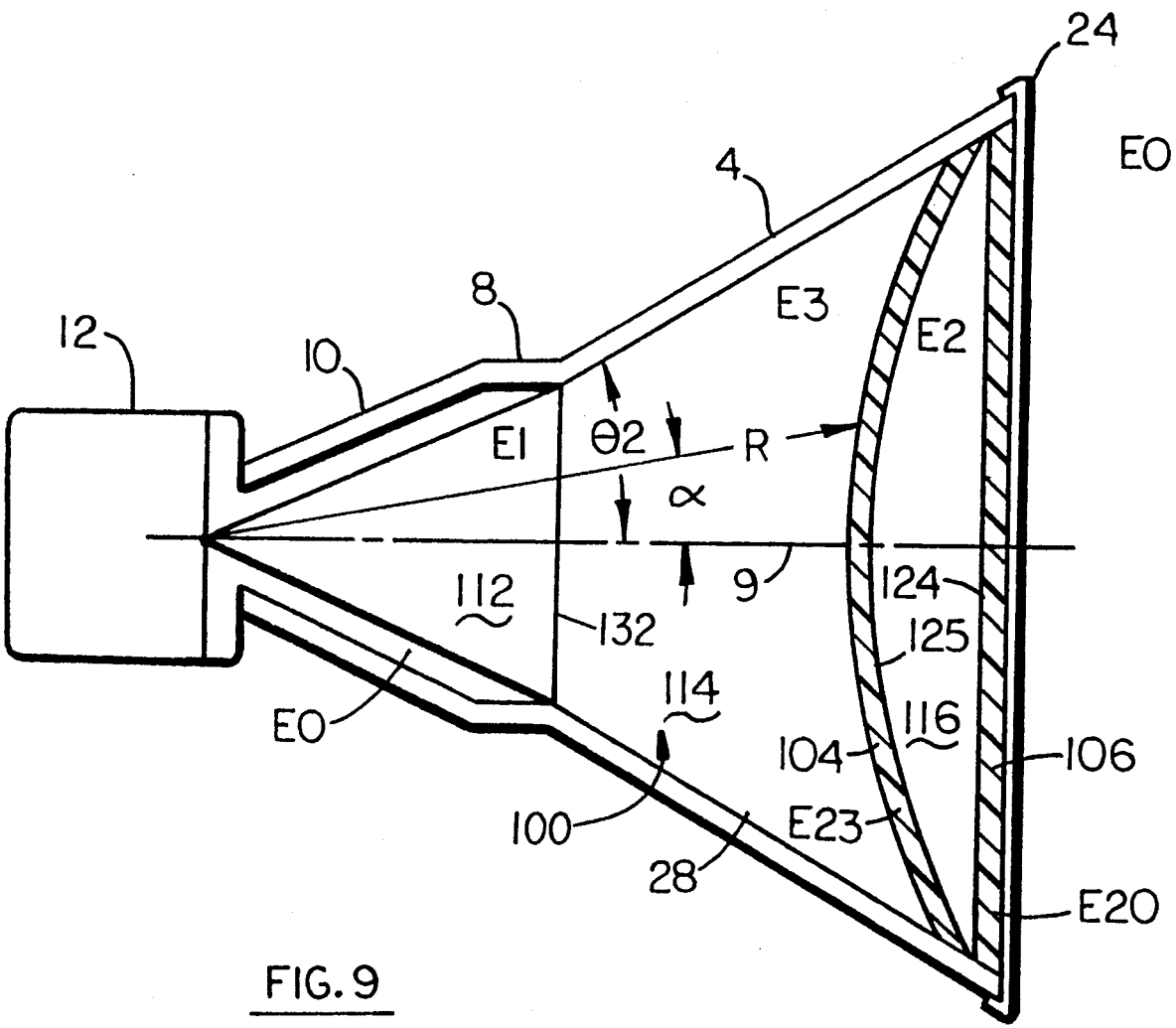
FIG. 9 shows a cross-section drawing through an antenna including a three-section, heterogeneous collimator including a conical internal section coupled via a spacer section to a forward section having a planar forward surface and a hyperbolic aft surface and wherein anti-reflective liners cover the fore and aft surfaces of the forward section.

FIG. 9 shows an arrangement of the former type wherein a conic mode transducer section 112 extends through the stages 8 and 10. Such a structure not only improves the environmental integrity of the horn interior but also provides advantages of mechanical support.

Alternatively, an air gap may be allowed to exist over part or all of the collimator section mounted within stage 4. At the stage 8, the collimator section would be permitted to fill the entire cylindrical stage 8 to seal the aperture to the following stage 10 and wave guide 12. The higher dielectric, outer collimator section of E2 material would, in turn, seal the stage 4 through contact with the aperture 6.

By way of a further improvement to the collimator 90, Applicants at the assembly of FIG. 9 have provided a zone of lower dielectric constant material 114 of value E3 in the region of the stage 4. The curvatures of the modified surfaces are defined per the equations, above, but wherein the value of the dielectric constant E3 is substituted for E1.

By employing a dielectric discontinuity or section 114, forward of the matching section 8 and between the forward and interior collimator sections 92 and 94, the focus of the spherically convergent waves can be fine tuned. Although the earlier mentioned surface aberrations 64 can be used to a similar end, uniformly constructed layers are more readily achieved in a production environment.

Figure 10:
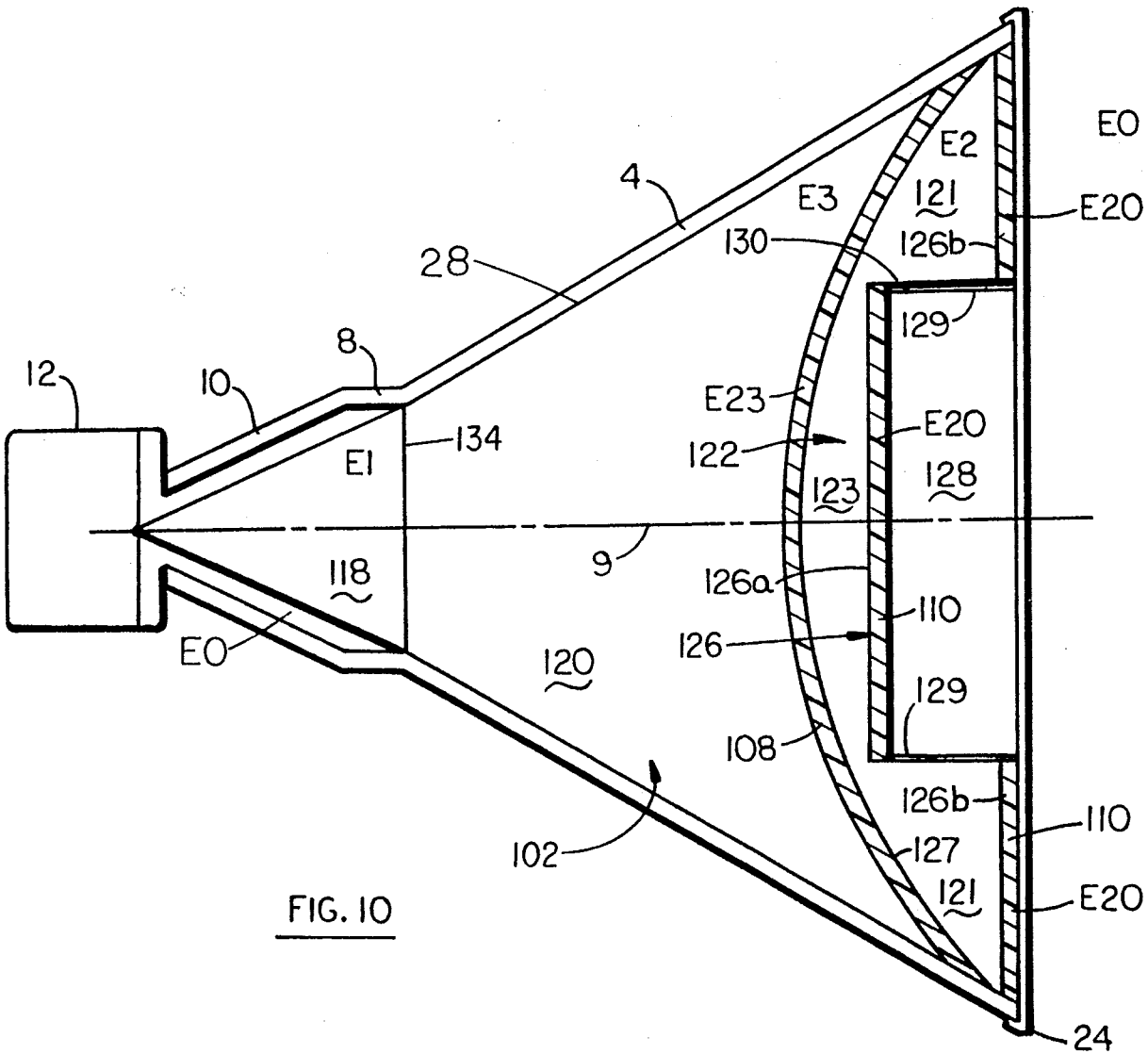
FIG. 10 shows a cross-section drawing through an antenna including a three-section heterogeneous collimator like that of FIG. 8 but wherein the forward section exhibits a Fresnel shaped forward surface, including metalized recess sidewalls, and a hyperbolic aft surface.

With the foregoing in mind, attention is particularly directed to the constructions of FIGS. 9 and 10 and wherein Applicants have also determined that the addition of relatively thin layers or sections of materials of intermediate or impedance matching dielectric constant improve and have significant impact on the performance of the multi-section collimators 100 and 102 disclosed therein.

From FIGS. 9 and 10, anti-reflective layers or thin collimator sections 104, 106 and 108, 110 of materials of dielectric constant values E23 and E20 have been inserted on both sides of the most-forward of the three collimator sections 112, 114, 116; 118, 120, 122 of each collimator 100 and 102. Each of the collimator sections 116 and 122 particularly provide a hyperbolic aft interface surface 125, 127 of a configuration comparable to the structure of FIG. 8, but wherein the sections 114 and 120 of E3 material each extend to the horn walls. By permitting the material to extend to the horn walls, structural simplicity is also obtained to seal the majority of the horn interior against expansion and convection with pressure changes.

The forward surfaces comprise a planar surface 124 and a Fresnel surface 126, which includes portions **126*a* and 126*b*. Otherwise, the dielectric constant E2 of the collimator sections 116 and 122** is selected in the range of 2.0 to 2.5.

The intermediate collimator sections 114, 120 are typically selected from a foam dielectric material of value E3 in the range of 1.02 to 1.10. The most aft collimator sections 112, 118 are, in turn, selected from a bulk material of value E1 in the range of 1.15 to 1.4, except for the critical air gap adjacent the horn wall and in the matching stage drift space. In combination the composite of the three sections of each collimator 100, 102 permits the appropriate formation and rephasing of hybrid modes in the waves and which ultimately allows the waves to converge and re-form as a plane wave at the cylindrical wave guide 12 which terminates the horn.

The dielectric constant E20 of the forward layers 106, 110 is selected to match the wave impedance of the layers 106, 110 to air or E0. In that regard and applying classical theories of wave matching for dielectrics whose dimensions are large with respect to a wave length and for a dielectric constant material E2 on the order of 2.5, the dielectric constant of the matching layers 106, 110 is selected to be the square root of the dielectric constant (i.e. $E20=\sqrt{(E2\times E0)}$) of the materials on either side of the matching film. The thickness of the layers 106, 110 are each also constructed to be ¼ wave length at the determined dielectric constant. Both values can be readily determined; and E20 is therefore typically selected to be in the range of 1.4 to 1.6. The layers 104, 106; 108, 110, are also typically constructed from a low density, low loss foamed plastic such as expanded polystyrene or polyethylene of appropriate densities.

For the structures of FIGS. 9 and 10, a wave entering parallel to the longitudinal horn axis 9 passes through the layers 106 and 110 to enter the collimator sections 116, 122 without reflecting or being bent until reaching the aft interface surfaces 125, 127. There and over a very short distance of the layers 104, 108, the wave is bent to form a spherically convergent, in-phase wavefront which moves through the collimator sections 114, 120 of dielectric constant E3.

The hyperbolic layers 104, 108, otherwise, must be designed to operate at known angles of incidence which exist for off-axis angles of alpha between 0 and a maximum angle $\alpha m \leqq \theta_2$. The defining equation for the preferred dielectric constant E23 in the layers 104, 108 is approximately:

$$E23 \simeq \sin^2\gamma + \cos\gamma\sqrt{E2/E3 - 1 + \cos^2\gamma}\ ,$$

where sin $\gamma$ is the numerical solution to:

$$\sin\gamma = \sin(\alpha_M + \sqrt{E3}\ /E2\ \sin^{-1}\gamma)$$

The thickness of the layers 104, 108 (measured normal to the plane of the layer at any generating angle $\alpha$) can be determined from the free-space wavelength $\lambda_0$ by:

$$d = \frac{\lambda_o}{4\sqrt{E3}} \times \frac{1}{\sqrt{\cos\beta}\ (E2/(E3 - \sin^2\beta))^{\frac{1}{4}}}\ ,$$

where is found by solving:

$$\sin\beta = \sin(\alpha + \sqrt{E3/E2}\ \sin^{-1}\alpha).$$

With further attention to FIG. 10 and the two zone Fresnel shaped collimator section 122, comprised of sections 123 and 121, the plane wave entering the recess 128 of the section 122 must arrive at all points of the interface surface 127 appropriately in phase to still constitute a parallel wave. Thus, the discontinuity in the thickness of the section 122 between the surfaces **126*a* and 127 and 126*b* and 127 must be sufficiently thick to allow exactly an integral multiple of wavelengths shift between the relatively fast wave continuing to move through air in the recess 128 and that which has been slowed in the annular region 121 surrounding the recess 128**. The size of the discontinuity can be expressed given the frequency and the dielectric constants E2 and E0 (where E0=1), as:

$$\Delta L = \lambda_o/(\sqrt{E2} - 1).$$

A further improvement of the antenna of FIG. 10 may be realized if a metalized film 129 is provided at the annular sidewall 130 of the recess 128. The wave passing through the recess 128 travels at a higher velocity than the adjacent portion of the wave traveling through the dielectric of the lens in the annular region 122. Waves traveling parallel to each other but at different velocities couple energy from the fast wave to the slow wave, analogously to directional couplers. This results in a phase distortion of the lens and a lower aperture efficiency. Such a film 129 has been found to improve the performance of the collimator 102. That is, an improvement in signal gain of approximately 0.5 dB is achieved by adding a film 129 of aluminum or copper at a thickness greater than the skin depth or approximately 10 micrometers, as opposed to not using a film 129. This improvement regains the efficiency lost through the use of the lighter weight Fresnel section 122.

A further distinction between the antenna of FIG. 10 over that of FIG. 9 is that stage 4 of the horn body 1 is extended in length to permit a larger outer diameter aperture 6. The larger diameter exhibits substantially the same pattern of sensitivity verses angle for a distant field signal, but with the absolute gain being increased proportional to the increased surface area of the aperture.

Figure 11:
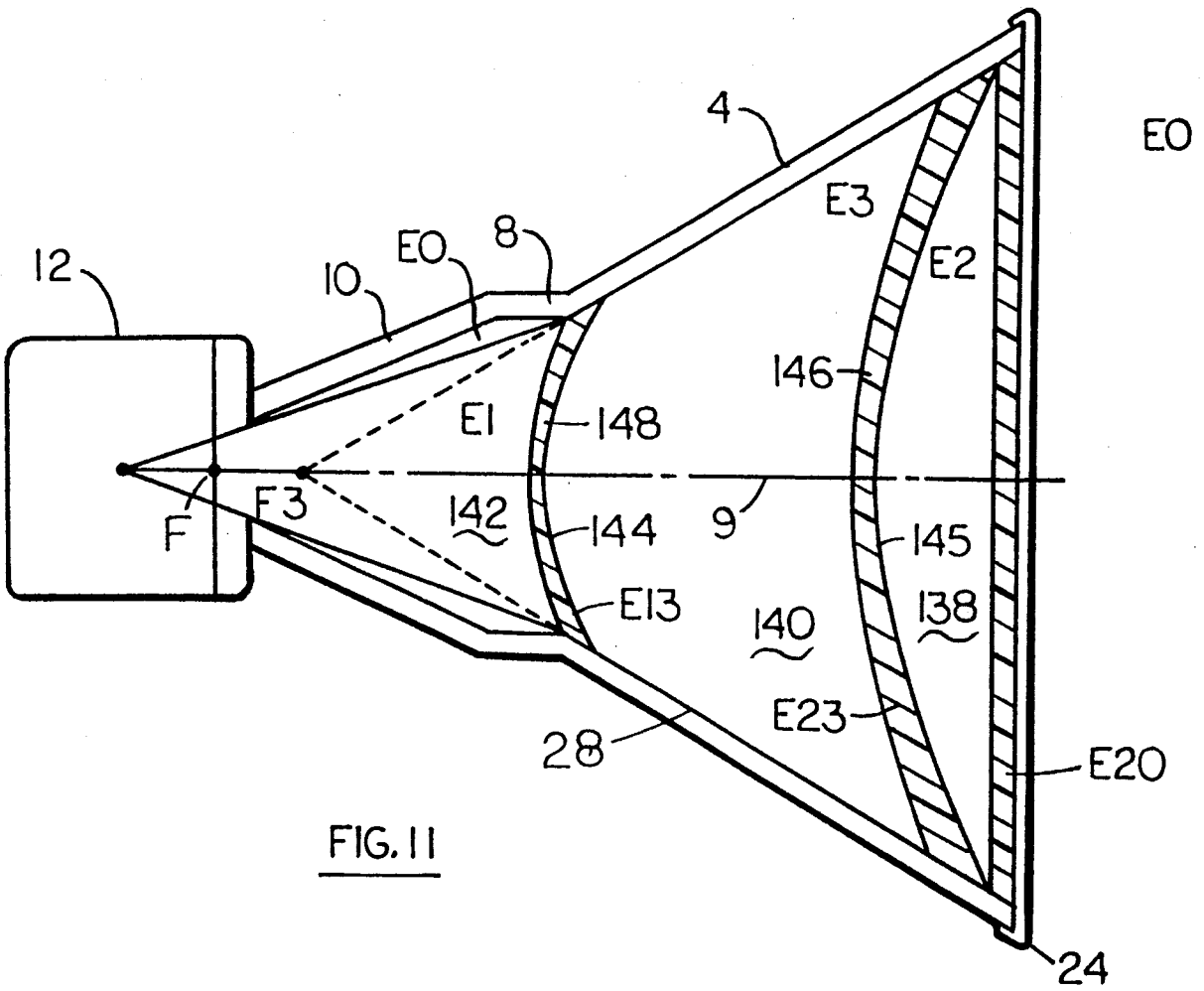
FIG. 11 shows a cross-section drawing through an antenna including a three-section collimator wherein anti-reflective layers are provided at each interface surface.

Extending the foregoing concepts, a matching interface layer can be added to the interface surface at the aperture to the matching stage 8 of either antenna of FIG. 9 or 10. Such a layer would be particularly added at the interface surfaces 132, 134 between the respective collimator sections 112, 114 and 118, 120. FIG. 11, depicts such a construction and is described below.

FIG. 11 illustrates a multi-section collimator 135 in which a hyperbolic interface surface 145 is lined with an anti-reflective layer 146 between collimator sections 138, 140 of dielectric constant values E2 and E3. Such a layer 146 causes the outermost rays arriving at the horn aperture 6 to parallel the conductive metalized wall 28 of the stage 4 as a spherically convergent wave focused on the focal point F3. The interface surface 144 between the sections 140, 142, in turn, is curved and includes a further layer 148 to refract the converging rays and effectively re-focus the rays to converge at the focal point F as a planar wave.

As depicted, each of the. preferred anti-reflective layers 146, 148 exhibits a taper of increasing thickness as they extend outward from the longitudinal axis 9. The actual equations for the generation of these surfaces, while too complex to present in detail, have been solved by use of a digital computer and wherefrom the general shape shown has been found to be optimal for E1=1.2 and E3=E0=1.

Figure 12:
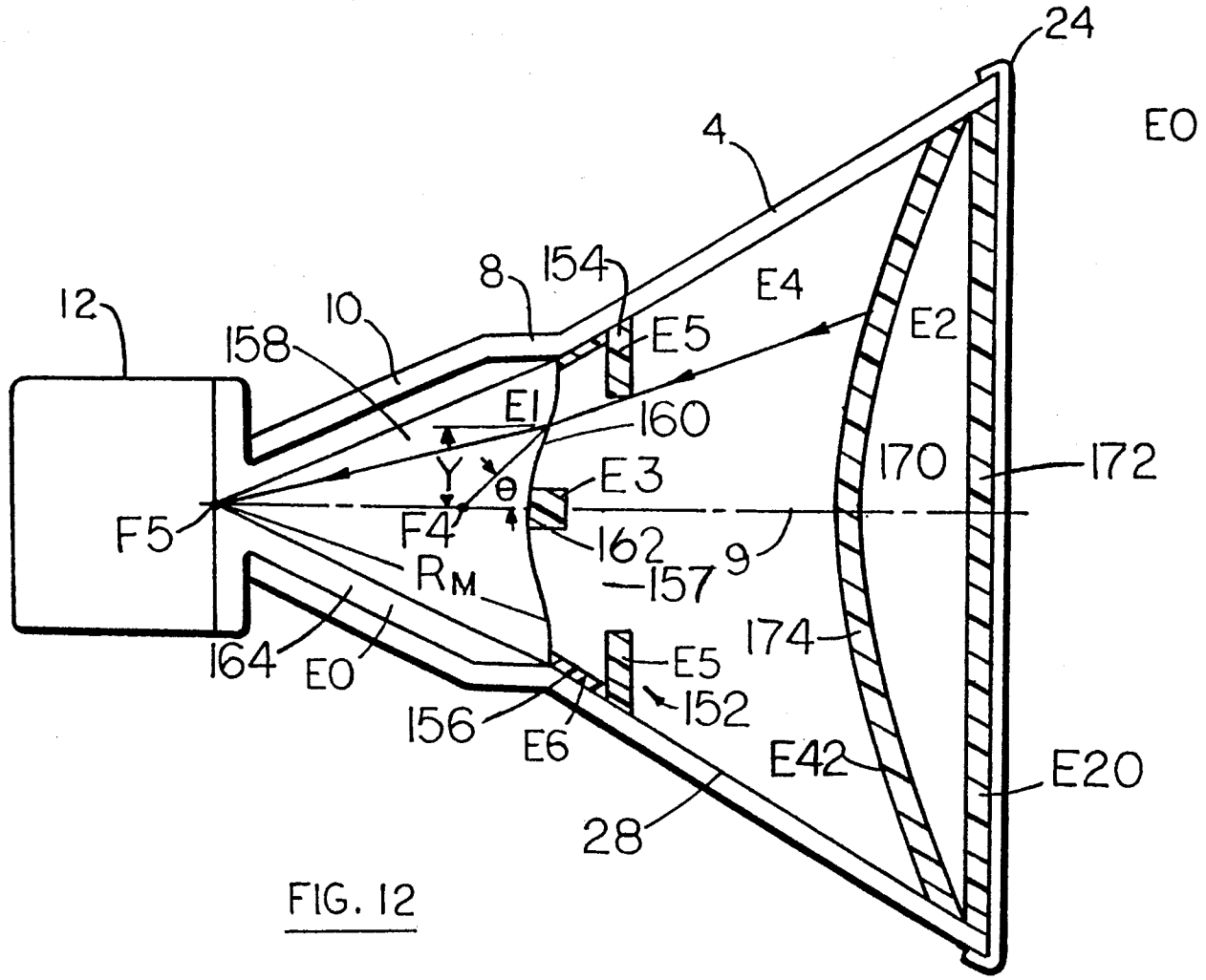
FIG. 12 shows a cross-section drawing through an antenna including a two-section heterogeneous collimator separated by an air gap, wherein the forward section is similar to that of FIG. 5 and the aft section exhibits a phase-correcting front surface including a coaxial cylinder projecting therefrom, an annular dielectric ring is mounted forward of the front surface, and a frustoconical shell portion extending therebetween.

FIG. 12 shows an antenna assembly similar to that of FIG. 10 but including a multi-section mode transducer assembly 152. The assembly 152 comprises a forward, annular dielectric member 154 of dielectric constant E5 which is backed by a conical liner section 156 of dielectric constant E6 and both of which contact the conductor 28 within the state 4 forward of the stage 8. In combination, the members 154, 156 create a dielectric "iris" or aperture 157 to the conical aft collimator section 158 of dielectric constant E1. The collimator section 158 includes a shaped forward surface 160 that further includes a cylindrical dielectric rod 162 of dielectric material E3 which projects along the longitudinal axis 9. The dielectric rod 158 is approximately one wavelength long and one-fourth to one-half wavelength in diameter. These dimensions, taken with the dielectric aperture 157, as well as the dielectric constants E1, E3, E5 and E6 of these components, are selected for an optimum match to the mode content of the received radiation sample as it emerges from the forward collimator section 170 and enters the region of dielectric value E4.

The wave sample is refocused at the entrance to the conical collimator section 158 to match a $TE_{11}$ wave mode at the exit focus F5 at the wave guide 12. This refocusing is accomplished by contouring the forward surface 160 of the conical section 158 in accordance with Fermat's principle and Snell's law. FIG. 12 illustrates the geometrical considerations which are further embodied in the following transcendental equations which define this contour.

$$\sqrt{E1}\,(r^2+v^2+2vr\cos\theta)^{\frac{1}{2}}+\left(\frac{D}{2\sin\theta}-r\right)\sqrt{E2}-\left(\frac{D}{2\sin\theta_M}+v^2+\frac{VD}{\tan\theta_M}\right)^{\frac{1}{2}}=0$$

$$x=r\cos\theta;$$
$$y=r\sin\theta$$

For these equations, V is the phase center shift or the distance between the focal point F4 of the collimator section 170 and the phase center F5 of the mode transducer assembly 152. Also, $R_m$ is the maximum inclined length of the conical section 158 and $G_m$ is the maximum extent of the angle between the axis 9 and a point on the forward surface 160. The variable $r_o$ is the radial distance from F4 to the diameter of the conical section 158.

The conical section 158, acting in concert with the boundary condition established by the conical air gap 164 and the conductor 28, converts the $HE_{11}$ mode to the dominant $TE_{11}$ mode at the exit of the antenna. It is to be understood that the cone angles of the collimator section 158 and the cone angle of the conductor 28 are critical to the efficient conversion of the $HE_{11}$ mode to the $TE_{11}$ mode.

The mode transducer assembly 152 and collimator section 170, including dielectric layers 172 and 174 must be designed as an integral set. As the sampled wave passes through the collimator section 170, some dispersion of the wave takes place, depending on the F/D and shape of the collimator section 170. This dispersion takes the form of energy being converted to higher amplitudes in the higher order modes. The mode transducer design is adjusted accordingly to match any mode distortion caused by the collimator section 170.

As the construction of the forward collimator section or incident surface is varied as illustrated in FIGS. 1 through 12, the corresponding construction of the aft, mode transducer portion of the collimator takes on different variations of design. Hence, the elements of the mode transducer assembly 152 shown in FIG. 12 may be used singularly or in different combinations to match the dispersion characteristics of a particular forward collimator section design. Similarly, elements of various of the other antenna assemblies of FIGS. 1 to 11 may be arranged in different combinations.

Although the present invention has been described with respect to its presently preferred and various alternative embodiments, it is to be appreciated that still other embodiments might be suggested to those of skill in the art upon reference thereto. Accordingly, it is contemplated that the invention should be interpreted to include all those equivalent embodiments within the spirit and scope of the following claims.

What is claimed is:

1. A horn antenna comprising:

a) an antenna body having a plurality of regions coaxially aligned along a longitudinal body axis and including a first region having a forward aperture which tapers inward to a cylindrical region and from an inner end of which cylindrical region a second region tapers inward to an aft aperture; and b) dielectric means for focusing electromagnetic radiation to the longitudinal body axis and including (1)

a first section mounted in the first region and a second section mounted aft of the first region wherein a dielectric constant of the first section is greater than a dielectric constant of the second section, and (2) dielectric interface means for interfacing with at least one of said first and second sections having a third dielectric constant between the first and second dielectric constants and a thickness which progressively increases with increasing radial distance from the longitudinal body axis.

2. Apparatus as set forth in claim 1 wherein the first, second and third dielectric constants are in the range of 1.15 to 2.55.

3. Apparatus as set forth in claim 1 wherein said dielectric means is constructed from a material selected from a class consisting of polymers, co-polymers, or foams of polyethylene or polystyrene.

4. Apparatus as set forth in claim 1 wherein the aft surface of said first section is hyperboloidal.

5. Apparatus as set forth in claim 1 wherein said first and second sections are separated by an air gap.

6. Apparatus as set forth in claim 1 including a third dielectric section mounted between said first and second sections and wherein the first, second and third sections and dielectric interface means substantially fill the interior of the antenna body.

7. Apparatus as set forth in claim 1 wherein an axial external surface of said second section coaxial with said longitudinal body axis is conical and wherein the second section mounts within the second region and extends into the cylindrical region and an air gap is defined between the antenna body and the second section.

8. Apparatus as set forth in claim 6 wherein said dielectric interface means interfaces with an aft hyperboloidal surface of the first section.

9. Apparatus as set forth in claim 1 wherein the dielectric interface means comprises a plurality of layers of dielectric material, wherein individual ones of the plurality of dielectric layers couple with selected forward and aft surfaces of said first and second sections and wherein at least one of the plurality of layers has a thickness which increases with increasing radial distance form the longitudinal body axis and a maximum thickness which is less than one wavelength of the radiation.

10. Apparatus as set forth in claim 9 wherein one of said dielectric layers mates with a forward planar surface of said first section and including weatherproof seal means secured to the forward aperture for sealing the antenna interior from the surrounding environment.

11. Apparatus as set forth in claim 1 wherein said second section is constructed of a material having a dielectric constant in the range of 1.15 to 1.40 and said first section is constructed of a material having a dielectric constant in the range of 2.0 to 2.55.

12. Apparatus as set forth in claim 1 including a cover transparent to impinging radiation and secured in weatherproof relation to the forward aperture.

13. Apparatus as set forth in claim 1 wherein an aft surface of the first section is hyperboloidal and a forward surface is planar.

14. Apparatus as set forth in claim 1 wherein at least one of said first and second sections is formed of a foamed material including a plurality of randomly dispersed electrically conductive particles.

15. Apparatus as set forth in claim 14 wherein said particles comprise metal coated particles of foam.

16. Apparatus for a horn antenna having a forward aperture and an aft aperture disposed along a longitudinal body axis comprising:

a) dielectric means supported in coaxial relation to the antenna body for focusing electromagnetic radiation to the longitudinal body axis and including first and second sections made from respective first and second dielectric materials and disposed along a longitudinal dielectric axis, wherein said second section is positioned aft of said first section and a dielectric constant of said first section is greater than a dielectric constant of said second section; and b) a plurality of dielectric layers each having a dielectric constant determined in a range between said first and second dielectric constants, wherein individual ones of the plurality of dielectric layers couple with selected forward and an aft surfaces of said first and second sections and wherein the thickness of at least one of said layers increases with increasing radial distance from the longitudinal dielectric axis.

17. Apparatus as set forth in claim 16 wherein at least one of said first and second sections includes a plurality of randomly dispersed and electrically conductive particles.

18. Apparatus as set forth in claim 16 including a third dielectric section mounted between the first and second sections and any intervening dielectric layer, wherein the first, second and third sections and plurality of dielectric layers substantially fill the interior of the antenna body, and wherein the aft surface of said first section presents a hyperboloidal surface.

19. Apparatus as set forth in claim 18 wherein a forward surface of said first section is planar.

20. Antenna apparatus comprising dielectric means for focusing electromagnetic radiation and hybrid modes thereof produced within electrically conductive interior walls of an antenna body toward an aft aperture including (1) first and second sections made from respective first and second dielectric materials having first and second dielectric constants, wherein the dielectric constant of the first section is greater than the dielectric constant of the second section, and (2) dielectric interface means for interfacing with at least one of the first and second sections having a third dielectric constant and a thickness which progressively increase with increasing radial distance from a longitudinal body axis; and wherein said antenna body comprises a first region having a forward aperture which conically tapers inward to a cylindrical region and from an inner end of which cylindrical region a second region conically tapers inward to the aft aperture, wherein each of the first, second and cylindrical regions are co-axial with the longitudinal body axis, wherein the first region exhibits a flare angle greater than a flare angle of the second region and wherein the first dielectric section mounts within the first region and the second dielectric section mounts aft of the first section and extends from the second region.

21. Apparatus as set forth in claim 20 including an air gap between the second dielectric section and the antenna body.

22. Antenna apparatus comprising dielectric means for focusing electromagnetic radiation and hybrid modes thereof produced within electrically conductive interior walls of an antenna body toward an aft aperture including (1) first and second sections made from respective first and second dielectric materials having first and second dielectric constants, wherein the dielectric constant of the first section is greater than the dielectric constant of the second section, and (2) dielectric interface means for interfacing with at least one of the first and second sections having a third dielectric constant and a thickness which progressively increases with increasing radial distance from a longitudinal body axis; and wherein said antenna body comprises a first region having a forward aperture which conically tapers inward to a cylindrical region and from an inner end of which cylindrical region a second region conically tapers inward to the aft aperture, wherein each of the first, second and cylindrical regions are co-axial with the longitudinal body axis, wherein the first region exhibits a flare angle greater than a flare angle of the second region and wherein the first dielectric section mounts within the first region and the second dielectric section mounts aft of the first section and extends from the second region and further including a cover transparent to impinging radiation secured to the forward aperture.

* * * * *

UNITED STATES PATENT AND TRADEMARK OFFICE

CERTIFICATE OF CORRECTION

PATENT NO. : 5,166,698

DATED : 11-24-92

INVENTOR(S) : Ashbaugh, et al

It is certified that error appears in the above-indentified patent and that said Letters Patent is hereby corrected as shown below:

Column 22, line 47, "increase" should read --increases--

Signed and Sealed this

Twenty-third Day of November, 1993

*Attest:*

Bruce Lehman

BRUCE LEHMAN

*Attesting Officer*

*Commissioner of Patents and Trademarks*